US008963739B2

(12) United States Patent
Clifford et al.

(10) Patent No.: US 8,963,739 B2
(45) Date of Patent: Feb. 24, 2015

(54) SEQUENTIAL BARRICADE LIGHT

(71) Applicant: Checkers Industrial Products, LLC, Broomfield, CO (US)

(72) Inventors: Scott Clifford, Mesa, AZ (US); Steven N. D. Brundula, Chandler, AZ (US)

(73) Assignee: Checkers Industrial Products, LLC, Broomfield, CO (US)

( * ) Notice: Subject to any disclaimer, the term of this patent is extended or adjusted under 35 U.S.C. 154(b) by 245 days.

(21) Appl. No.: 13/804,467

(22) Filed: Mar. 14, 2013

(65) Prior Publication Data

US 2014/0085108 A1 Mar. 27, 2014

Related U.S. Application Data

(60) Provisional application No. 61/704,658, filed on Sep. 24, 2012.

(51) Int. Cl.

| | |
|---|---|
| ***G08G 1/095*** | (2006.01) |
| ***G08G 1/0955*** | (2006.01) |
| ***E01F 13/02*** | (2006.01) |
| ***H05B 33/08*** | (2006.01) |
| ***H05B 37/02*** | (2006.01) |

(52) U.S. Cl.

CPC ..... *G08G 1/0955* (2013.01); *E01F 13/02* (2013.01); *H05B 33/0803* (2013.01); *H05B 37/0272* (2013.01)

USPC ..... 340/908.1; 340/907; 315/200 A

(58) Field of Classification Search

USPC ..... 340/908.1, 907, 471; 315/200 A

See application file for complete search history.

(56) References Cited

U.S. PATENT DOCUMENTS 4,132,983 A * 1/1979 Shapiro ..... 340/331
5,469,157 A * 11/1995 Carpenter et al. ..... 340/908.1

* cited by examiner

*Primary Examiner* — Toan N Pham
(74) *Attorney, Agent, or Firm* — Holland & Hart

(57) ABSTRACT

A barricade light includes a light member, a receiver, a transmitter and a controller. The receiver is configured to receive an incoming signal from an adjacent barricade light and deliver the incoming signal to the controller. The incoming signal includes information about a position of the adjacent barricade light in a row of barricade lights. The controller is configured to determine a position of the barricade light in the row of barricade lights based on the information, synchronize operation of the light member to the adjacent barricade light, and transmit an outgoing signal via the transmitter. The outgoing signal includes information about a position of the barricade light in the row of barricade lights.

35 Claims, 47 Drawing Sheets

SEQUENTIAL BARRICADE LIGHT

RELATED APPLICATION

This claims the benefit of U.S. Provisional Application No. 61/704,658, filed 24 Sep. 2012, which is hereby incorporated by reference herein in its entirety.

BACKGROUND

Barricades are often used to block traffic from an area or hazard, or to direct traffic in a particular direction. For example, barricades are often used alone or in a group to mark potholes or other road hazards. Barricade lights are commonly used to make the barricades more visible, particularly during low-light periods. Barricade lights are generally capable of operating in a flashing mode to provide improved visibility. Barricade lights may be powered by a battery. In some designs, the battery is carried in the housing of the barricade light. In the recent past, LEDs have increasingly replaced incandescent bulbs as the primary light source used in barricade lights.

Barricade lights set in a flashing mode, when mounted to a plurality of barricades spaced apart from each other, usually create a random flashing pattern, making it difficult to discern a depth between the barricades. When the barricades are lined up in a row, such depth perception may be important for motorists, particularly under low-light conditions when the barricades are not clearly visible and the only visible portion is the barricade light.

Opportunities exist for improving barricade lights and barricade light systems.

SUMMARY

As will be described in greater detail below, one aspect of the present disclosure relates to a barricade light that includes a light member, a receiver, a transmitter and a controller. The receiver is configured to receive an incoming signal from an adjacent barricade light and deliver the incoming signal to the controller. The incoming signal includes information about a position of the adjacent barricade light in a row of barricade lights. The controller is configured to determine a position of the barricade light in the row of barricade lights based on the information, synchronize operation of the light member to the adjacent barricade light, and transmit an outgoing signal via the transmitter. The outgoing signal includes information about a position of the barricade light in the row of barricade lights.

The transmitter may be configured to transmit an infrared (IR) signal. The light member may include a high intensity light emitting diode (LED). The light member may operate to create a flash. The light member may operate to maintain a backlight state between flashes. The barricade light may include a solar panel configured to generate solar power for operation of the barricade light. The barricade light may include a rechargeable battery. The rechargeable battery may include a Lithium Iron Phosphate (LiFePO) battery. The barricade light may include an ambient light sensor configured to generate a dimming signal when a light condition exceeds a threshold condition, wherein the controller automatically dims the light member in response to the dimming signal. The information in the signal may include timing of operation of the adjacent barricade light. The receiver may face in a direction opposite the transmitter.

Another aspect of the present disclosure relates to a barricade light assembly that includes a plurality of barricade lights aligned in a row. Each barricade light includes a light member, a receiver, a transmitter and a controller. The receiver of a first barricade light is configured to receive an incoming signal from a second barricade light. The incoming signal includes information about a position of the second barricade light in the row. The controller of the first barricade light is configured to determine a position of the first barricade light in the row based on the information, synchronize operation of the light member to operation of the light member of the second barricade light, and transmit an outgoing signal via the transmitter to the receiver of a third barricade light. The outgoing signal includes information about the position of the first barricade light in the row.

The receiver of the first barricade light may be configured to receive an incoming signal from a plurality of barricade lights, wherein each incoming signal includes a position value representing a position of the barricade light in the row, and the controller of the first barricade light is configured to determine which incoming signal has a highest position value. The light member and receiver of each barricade light may face forward, and the transmitter of each barricade light may face rearward. Each barricade light may further include a solar panel. The controller of each barricade light may automatically update a flashing sequence of the light member based on a flashing sequence of an adjacent barricade light.

Another aspect of the present disclosure relates to a method of operating a barricade light. The method includes providing a barricade light having a light member, a receiver, a transmitter, and a controller, wherein the transmitter faces in a direction opposite the receiver. The method also includes receiving at least one signal transmitted from at least one other barricade light in a row of barricade lights with the receiver, determining a position in the row of barricade lights with the controller, synchronizing a flash by the light member with the at least one other barricade light based on the position, and transmitting information about the position via the transmitter.

Determining a position in the row of barricade lights may include determining which one of the at least one signal has a highest position value, and assigning the barricade light a next highest position value. Synchronizing a flash by the light member may include generating the flash about ⅙ second after receiving the at least one signal. Synchronizing the flash may include generating a flash by the light member about every 1 second. The method may include masking the at least one signal if not received within a ⅙ second interval of receiving other signals of the at least one signal. The method may include transmitting information about the position prior to generating a flash with the light member.

The method may include generating the flash within about 50 milliseconds of transmitting information about the position. Receiving may occur in a first direction, and transmitting may occur in an opposite direction. The method may include directing a flash of the light member in a direction opposite of transmitting information about the position. The method may include providing the barricade light with an ambient light sensor, and automatically dimming a light output of the light member based on an output of the ambient light sensor.

Another example method in accordance with the present disclosure relates to a method of operating a group of barricade lights. The method includes providing each barricade light with a receiver, a transmitter and a light member, and arranging the group of barricade lights in a row with the receiver of each barricade light facing in a forward direction and the transmitter of each barricade light facing in a rearward direction. Each barricade light determines a position within the row based on signals transmitted by transmitters of forward positioned barricade lights and received by the receiver, and synchronizes a flash output by the light member based at least in part on the position.

The signals may include information about a position of the barricade light. The signals may be transmitted just prior to generating a flash by the light member. Upon start up of the barricade light, the barricade light may scan for signals transmitted by transmitters of forward positioned barricade lights, and if no signal is received, determines a 0 position for the barricade light and then generates a flash by the light member. Upon start up of the barricade light, the barricade light may scan for signals transmitted by transmitters of forward positioned barricade lights, and if a signal is received, determines the position for the barricade light based on the signal, and then waits for the same signal to be received again to synchronize a flash by the light member with flashes by other barricade lights.

The barricade light may wait for about ⅙ second after receiving the second of the same signal before generating the flash. The barricade light may transmit an output signal with the position prior to generating the flash. The position may be coded with a position value between 0 and 15. The method may include spacing the barricade lights between about 6 ft. apart and about 60 ft. apart.

Features from any of the above-mentioned embodiments may be used in combination with one another in accordance with the general principles described herein. These and other embodiments, features and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
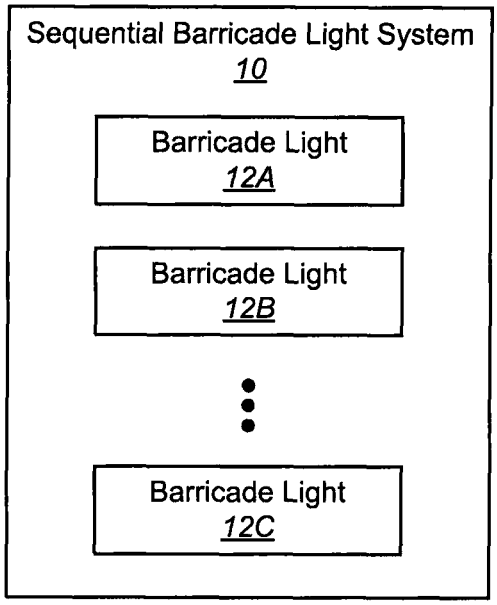
FIG. 1 schematically represents an example sequential barricade light system in accordance with the present disclosure.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, one of skill in the art will understand that the exemplary embodiments described herein are not intended to be limited to the particular forms disclosed. Rather, the instant disclosure covers all modifications, equivalents, and alternatives falling within the scope defined by the appended claims.

DETAILED DESCRIPTION OF EXEMPLARY EMBODIMENTS

As will be described in greater detail below, the present disclosure relates generally to barricade lights, and more particularly relates to sequential barricade lights, related sequential barricade lighting systems, and methods of sequencing flashing barricade lights. An example barricade light includes a receiver, a transmitter, a controller or control module, and a light device. The barricade light receives signals transmitted from adjacent barricade lights, determines a position in a line or row of the barricade lights based on the received signals, operates the light device to flash in synchronization (e.g., in an ordered sequence) with the row of barricade lights, and transmits a signal with information related to a position of the barricade light in the row of barricade lights. The barricade light may synchronize the generation of a flash by the light device based on when the signal is received from the adjacent barricade lights rather than observing the light output of adjacent barricade lights.

In general, the barricade lights disclosed herein automatically determine a position of the barricade light in a row of barricade lights, automatically generates a flash of light in synchronization (e.g., sequence) with the other barricade lights in the row, and automatically transmits a signal to other barricade lights in the row with information about the determined position of the barricade light in the row.

A row of barricade lights that each includes the capabilities discussed above may provide automatic sequencing of light flashes along the row. The row of barricade lights together may generally be referred to as a sequential barricade light system. The sequential barricade light system may automatically update the sequence of flashing lights at start-up of each individual barricade light and when any one of the barricade lights goes out or is moved into or out of the row.

At least some of the barricade lights disclosed herein may include a solar panel that provides an ongoing source of power and may provide increased life of the battery pack for the barricade light. The controller of the barricade light may operate to provide different settings based on, for example, an ambient light condition. For example, the controller may dim the intensity of the light device during low-light conditions. The controller may also provide a backlight condition for the light device wherein the light device maintains a dim steady light between light flashes.

Referring to FIG. 1, an example sequential barricade light system 10 is shown including a plurality of barricade lights 12A, 12B, 12C. The sequential barricade light system 10 may operate as a whole to provide synchronous (e.g., in sequential order) light flashing for a row when the barricade lights 12A-12C are arranged in a row. The barricade lights 12A-12C communicate with each other by sending and receiving signals. The signals may include infrared (IR), wireless or directional radio frequency (RF) signals. These signals may include information about a position and operation of the barricade lights up and down the row.

Figure 2:
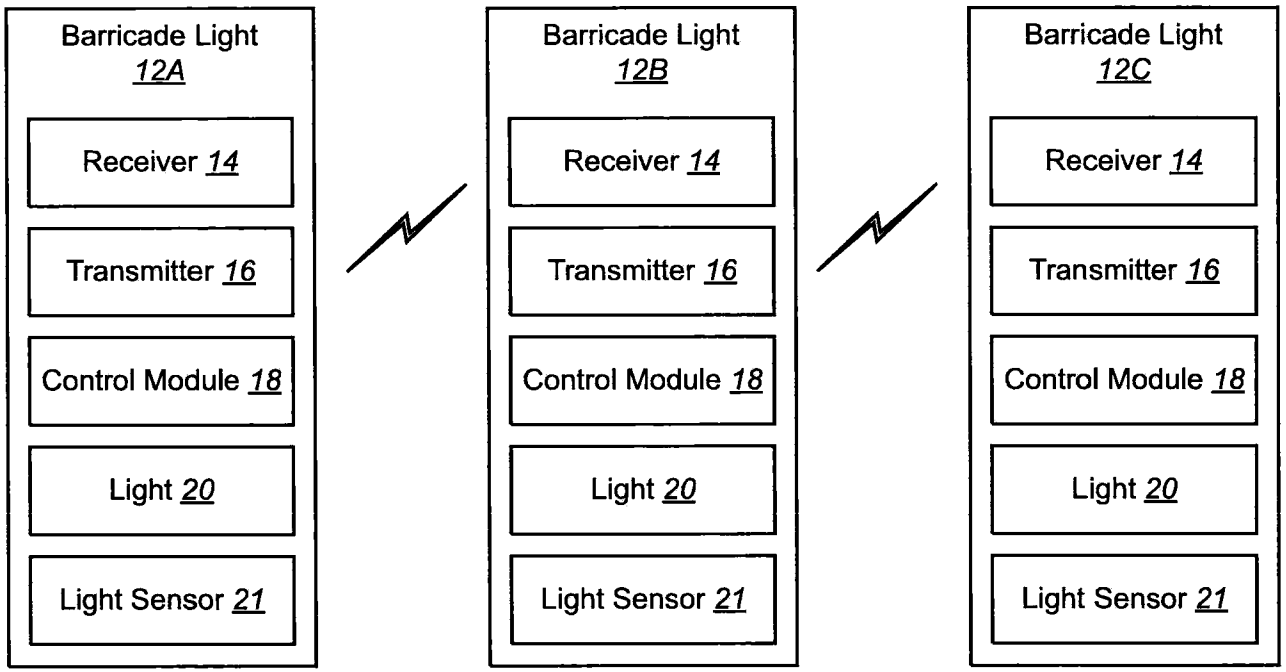
FIG. 2 schematically shows the sequential barricade light system of FIG. 1 in further detail.

FIG. 2 shows the barricade lights 12A-12C each including a receiver 14, a transmitter 16, a control module 18 (also referred to as a controller 18), a light 20, and a light sensor 21. The barricade lights 12A-12C may also include a power source (e.g., rechargeable batteries), which may include a solar panel. The transmitter 16 generates a signal that is received by the receiver 14 of a separate barricade light. Typically, the receiver 14 is positioned on a front surface of the barricade light and the transmitter 16 is positioned on a rear surface of the barricade light facing in an opposite direction from the receiver 14. The receivers 14 receive signals from transmitters that are positioned up the row of barricade lights. The transmitters 16 transmit signals in a direction down the row of barricade lights.

During operation, the receiver 14 receives signals from a plurality of barricade lights up the row, wherein each signal identifies the position of the barricade light from which the signal originates. The control module 18 operates to determine a position of the barricade light in the row based on the highest position number received. Once the highest number is determined, the control module assigns a code to itself representing the next number in the row. The control module then waits to receive a repeated second signal that includes the highest position number. If that same signal is repeated, the control module uses the second signal for synchronizing operation of the light 20. The light 20 flashes in sequence with light flashes of the barricade lights up the row. In one example, the control module waits ⅙ of a second after receiving the second signal before operating the light 20 to create a flash. In at least some embodiments, the light 20 comprises a high intensity light emitting diode (LED) light.

Thereafter, the control module continues to monitor the signals received by the receiver 14 to confirm that the same position in the row should be maintained, waits ⅙ of a second after receiving a signal that confirm the position, and then operates the light 20 to create a flash. In this manner, the barricade light is able to maintain confirmation of its position in the row on a real-time basis. In at least one example, all of the barricade lights 12A-12C operate to create a flash every second. Thus, each barricade light may check on a second-by-second basis to confirm its position in a row before creating a flash.

The control module 18 may also operate to transmit via the transmitter 16 a signal carrying its own position information. In one example, the signal is transmitted just prior to operating the light 20 to create a flash. For example, the signal may be transmitted less than about 50 milliseconds before operating the light 20. In other examples, the signal may be transmitted just after operating the flight 20. This slight delay between when the signal is transmitted and when the light 20 is operated may account for a delay in time for the signal to be transmitted by the transmitter 16, received by a receiver 14 of a barricade light down the row, and analyzed by the control module 18 where the signal is received. A barricade light positioned down the row may treat the time at which the signal is received as the same time as light is generated by that barricade light up the row for synchronization purposes.

Waiting about ⅙ of a second after receiving the signal to generate a light flash provides a delay of about ⅙ of a second between light flashes of adjacent barricade lights. The row of barricade lights may have light flashes in sequence about every ⅙ of a second for each barricade light down the row. This sequence of flashes may assist vehicle operators in determining the position of barricades carrying the barricade lights and may enhance depth perception of a position of the barricade lights.

Figure 3:
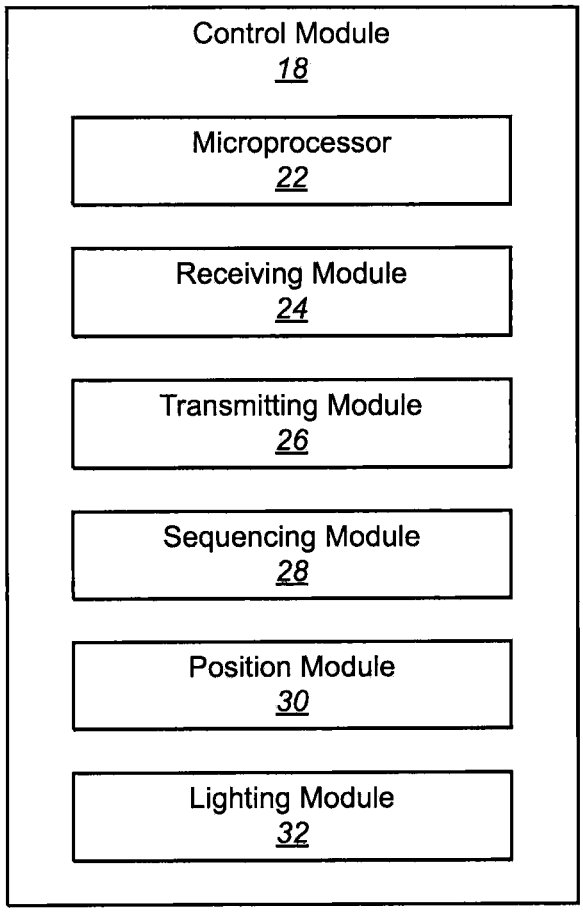
FIG. 3 schematically shows an example control module of the sequential barricade light system of FIG. 1.

Referring now to FIG. 3, the control module 18 is shown including a microprocessor 22, a receiving module 24, a transmitting module 26, a sequencing module 28, a position module 30, and a lighting module 32. The microprocessor 22 may operate to send and receive signals providing instructions for the various modules of the control module and other features of the barricade lights 12A-12C. The receiving module 24 may be associated with the receiver 14 to receive signals from barricade lights up the row. The receiving module 24 may identify information about the signal such as, for example, a position number (or code representing a position) of the barricade light from which the signal originated.

The transmitting module 26 may be associated with the transmitter 16, wherein a signal including information about a position of the barricade light is sent via the transmitter 16.

The sequencing module 28 may operate to provide timing between when the signal is received and when the light 20 is operated to create a flash. The sequencing module 28 may provide proper sequencing and/or synchronization of the light flashes of a barricade light with other barricade lights in the row. The sequencing module 28 may operate to provide adjustable delay periods between flashes of adjacent barricade lights. For example, delays of 2, 1, ½, ⅓, ¼, ⅕, ⅙, ⅛, or ⅒ of a second may be used.

The position module 30 may operate to determine a position of the barricade light relative to other barricade lights in the row. The position module 30 may identify which of the incoming signals received via the receiving module 24 includes the highest position value. The position module 30 assigns to the barricade light the next position number higher than the highest position number received.

The lighting module 32 operates to actuate the light 20 to create a flash of light. The lighting module 32 may also provide instructions for other functionality of light 20 including, for example, creating a backlight condition for light 20. A backlight condition may be a relatively low, steady light generated by light 20 that is maintained between flashes of light. The lighting module 32 may also provide dimming of light 20 based on, for example, feedback from light sensor 21 of the barricade lights 12A-12C. The light sensor 21 may monitor an ambient light condition. When an ambient light goes below a threshold light level, the lighting module 32 may provide dimming of an output or intensity of light 20. In one example, the dimming is in the range of about 25% to about 90%, more preferably in the range of about 50% to about 75%. The light sensor 21 may also determine when an ambient light condition goes above a certain light level, at which point the lighting module 32 may operate the light 20 to increase a light intensity.

Figure 4:
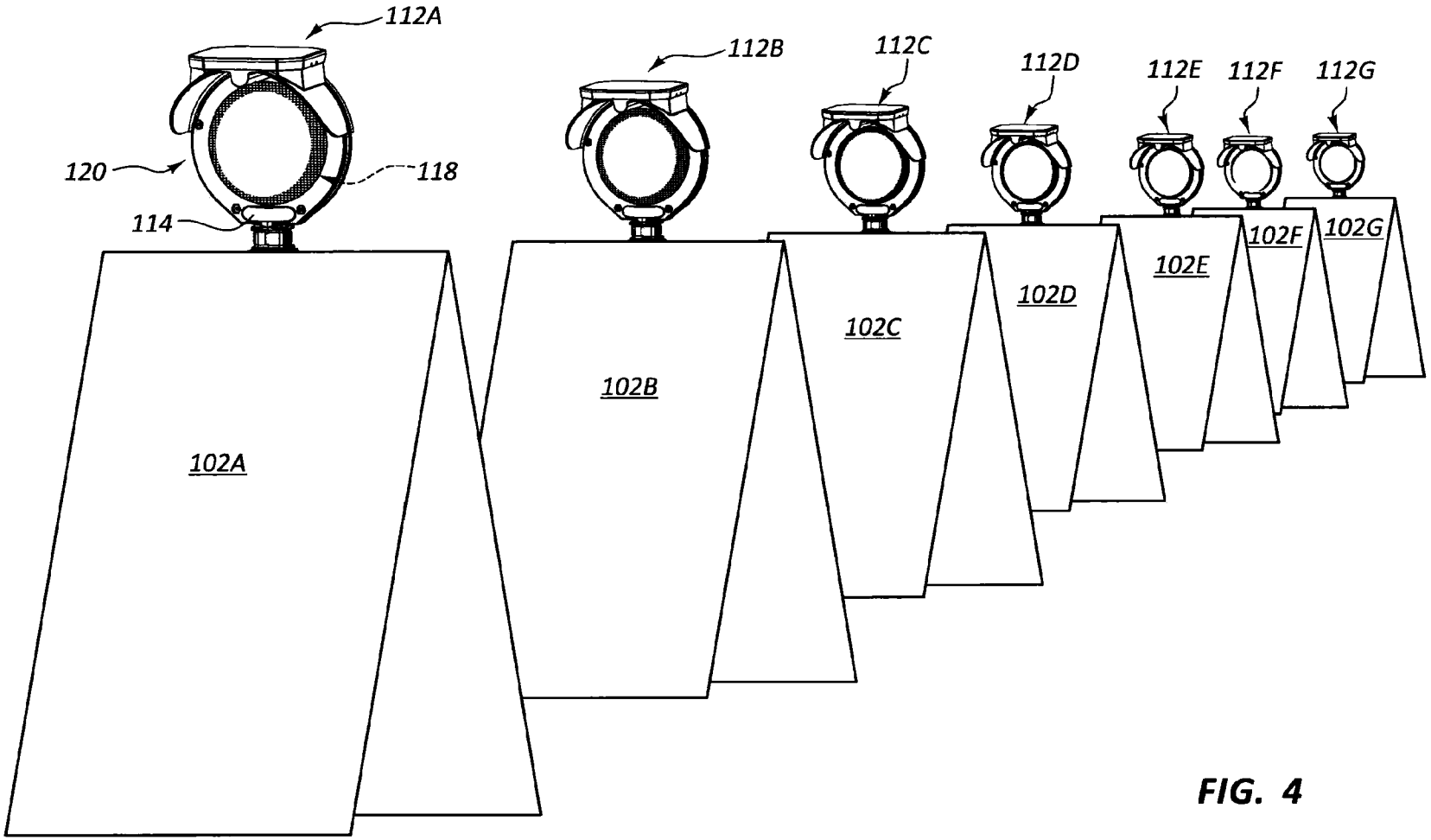
FIG. 4 shows a row of barricades, each supporting a barricade light in accordance with the present disclosure.

FIG. 4 shows a row of barricade lights 112A-112G mounted to a row of barricades 102A-102G. Each of the barricade lights 112A-112G includes a receiver 14 that faces in the same direction as a light device 120 is facing, which is in a forward direction up the row of barricade lights. A transmitter 116 (see FIG. 5) is positioned on the rear side of the barricade lights 112A-112G and faces down the row of barricade lights. Each barricade light 112A-112G includes a controller 118 (also referred to as a control module).

Figure 5:
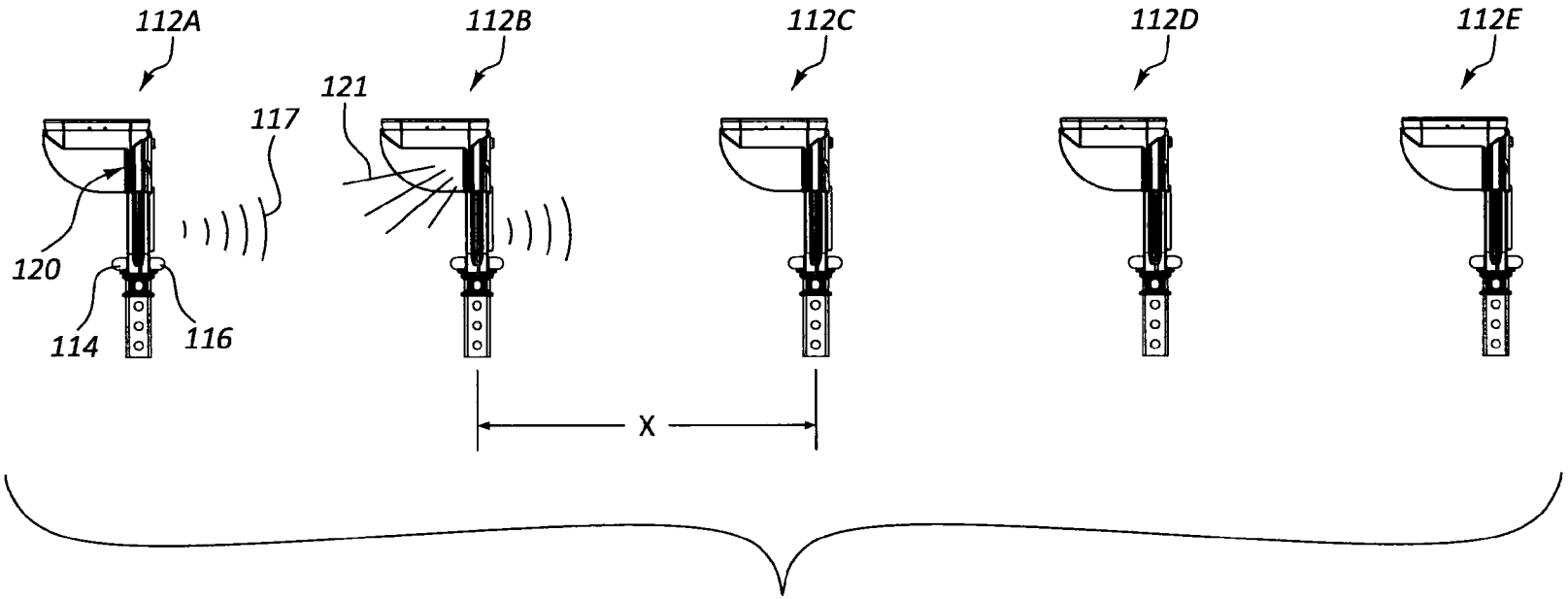
FIG. 5 is a side view of the barricade lights shown in FIG. 4.
Figure 6:
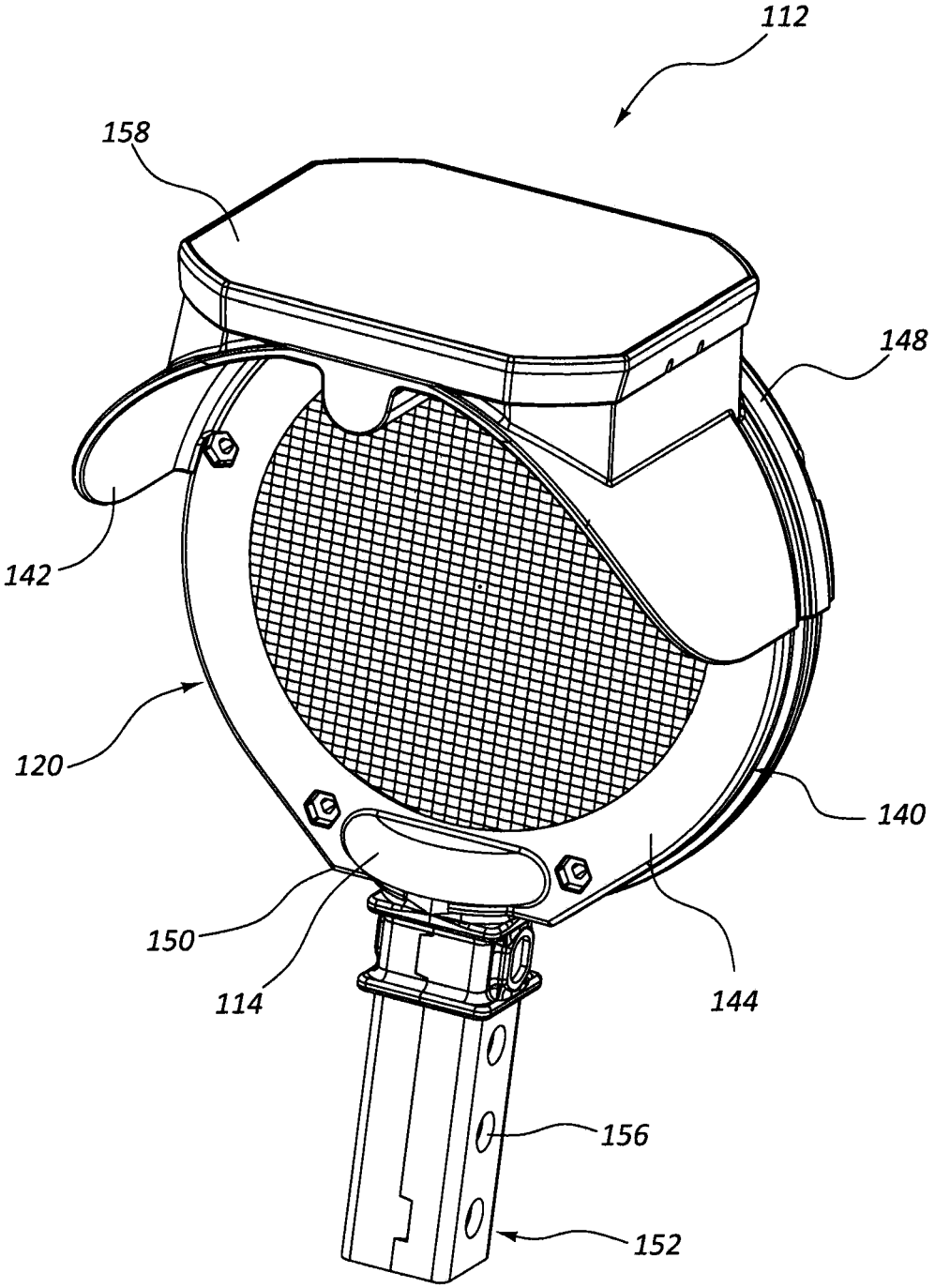
FIG. 6 is a perspective view of the barricade light shown in FIGS. 4 and 5.
Figure 7:
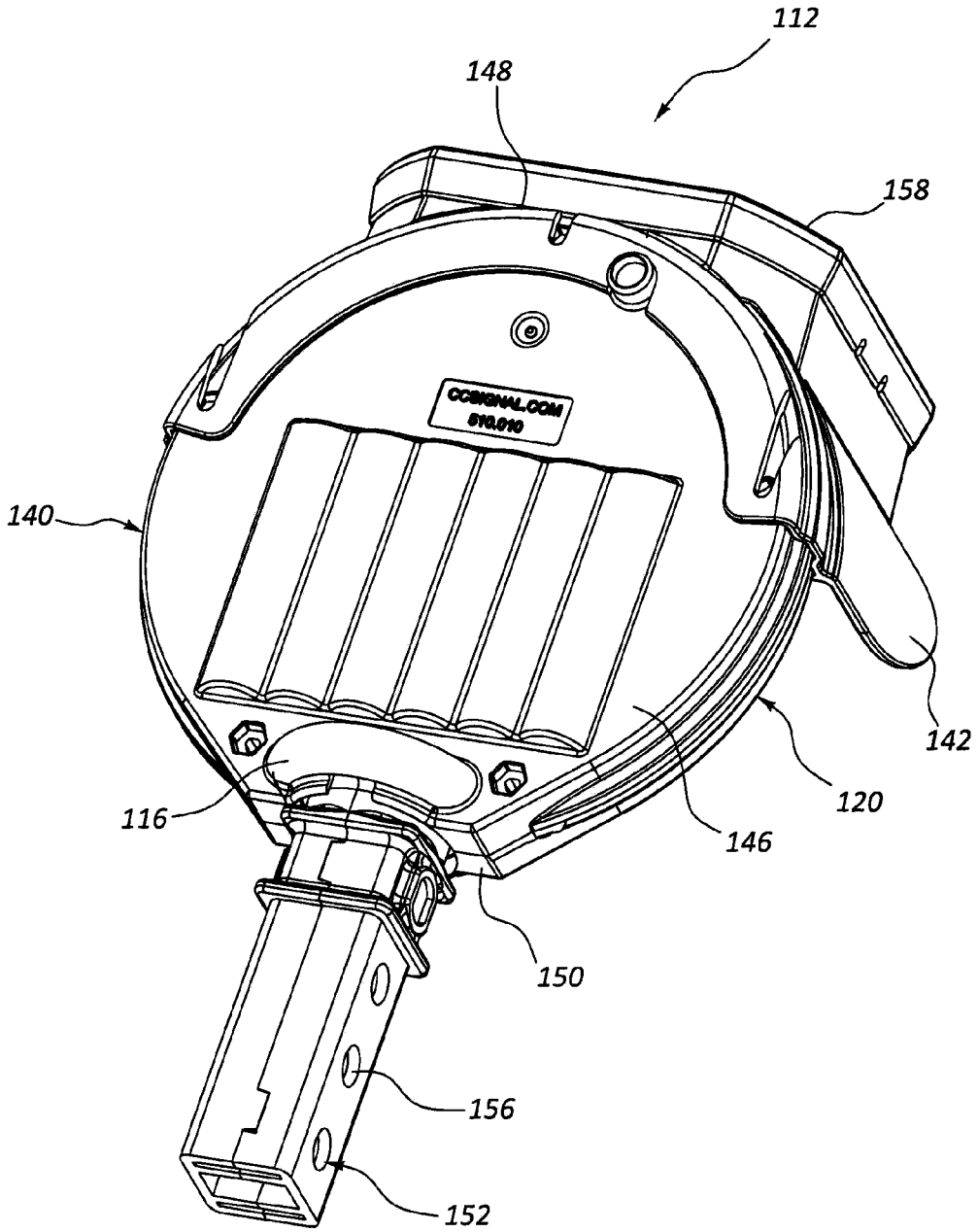
FIG. 7 is another perspective view of the barricade light shown in FIG. 6.
Figure 8:
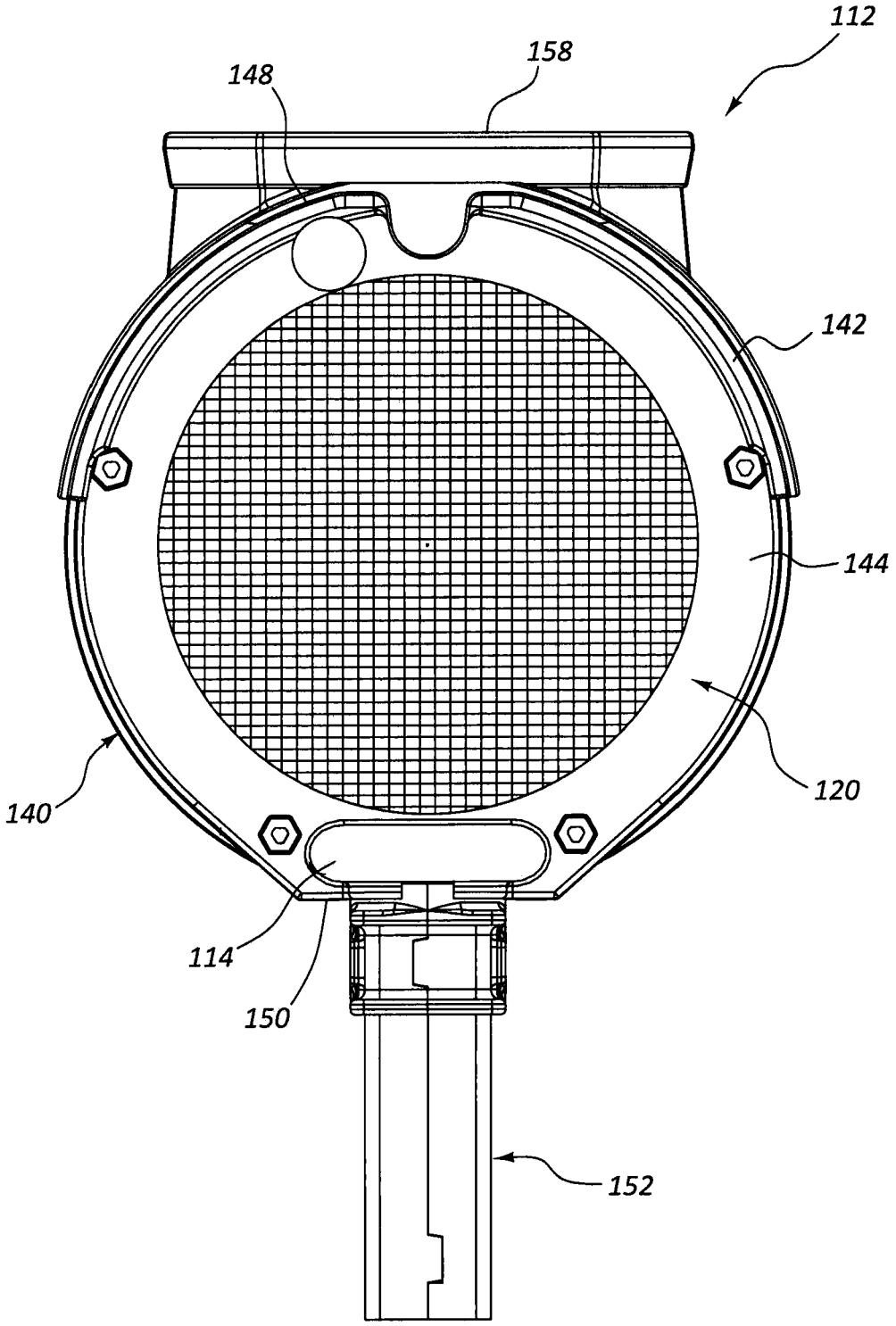
FIG. 8 is a front view of the barricade light of FIG. 6.
Figure 9:
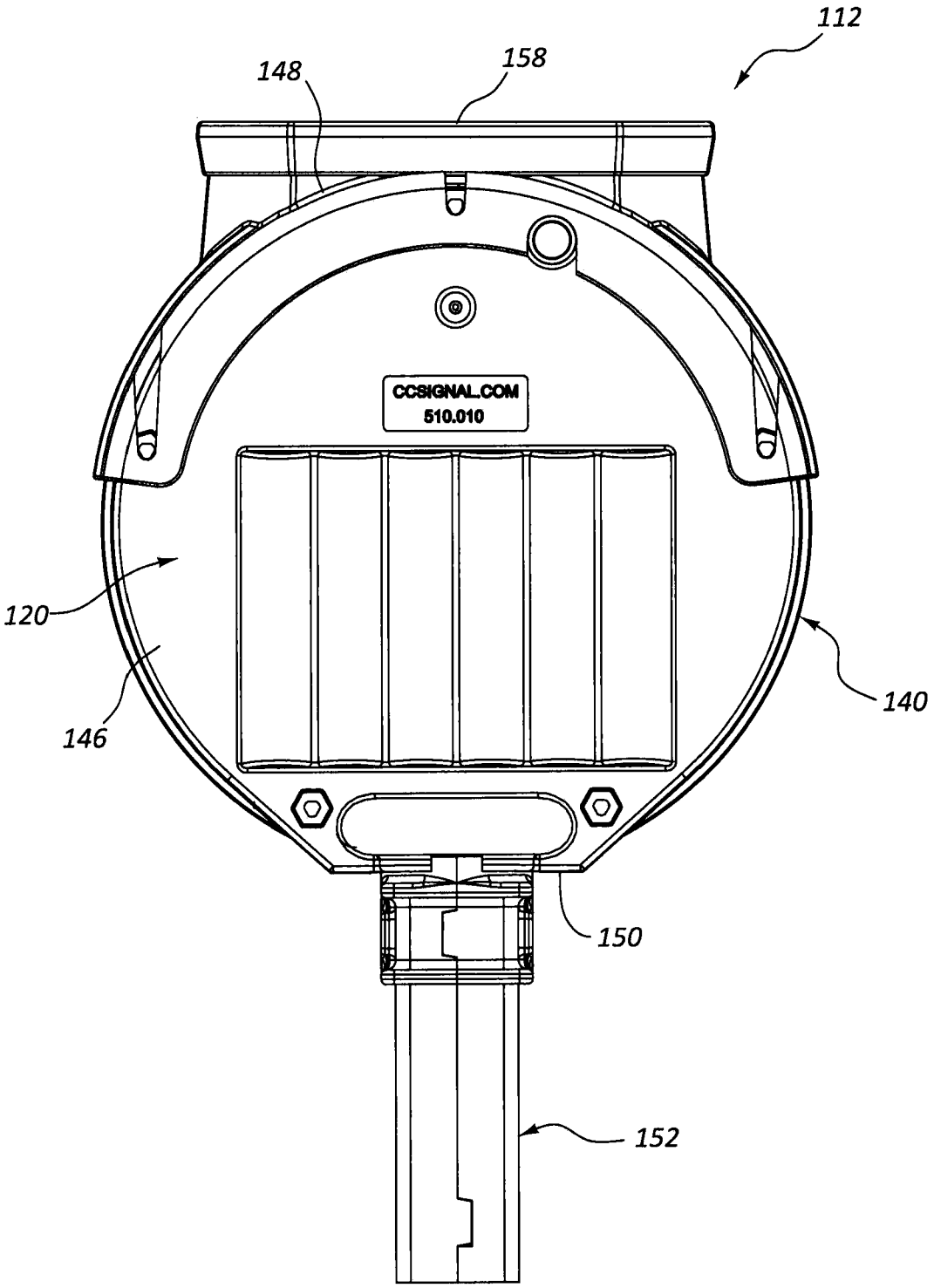
FIG. 9 is a rear view of the barricade light of FIG. 6.
Figure 10:
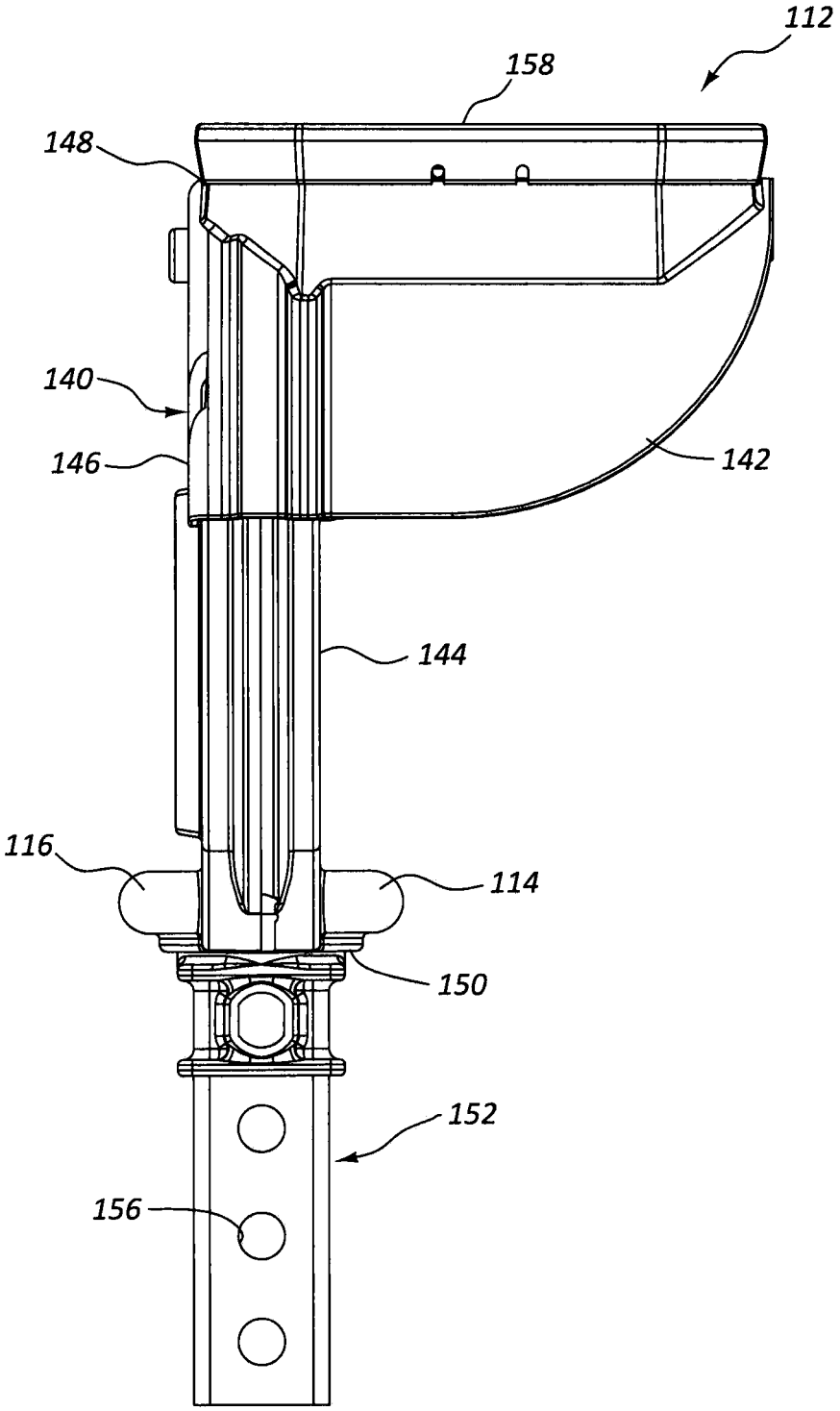
FIG. 10 is a left side view of the barricade light of FIG. 6.
Figure 11:
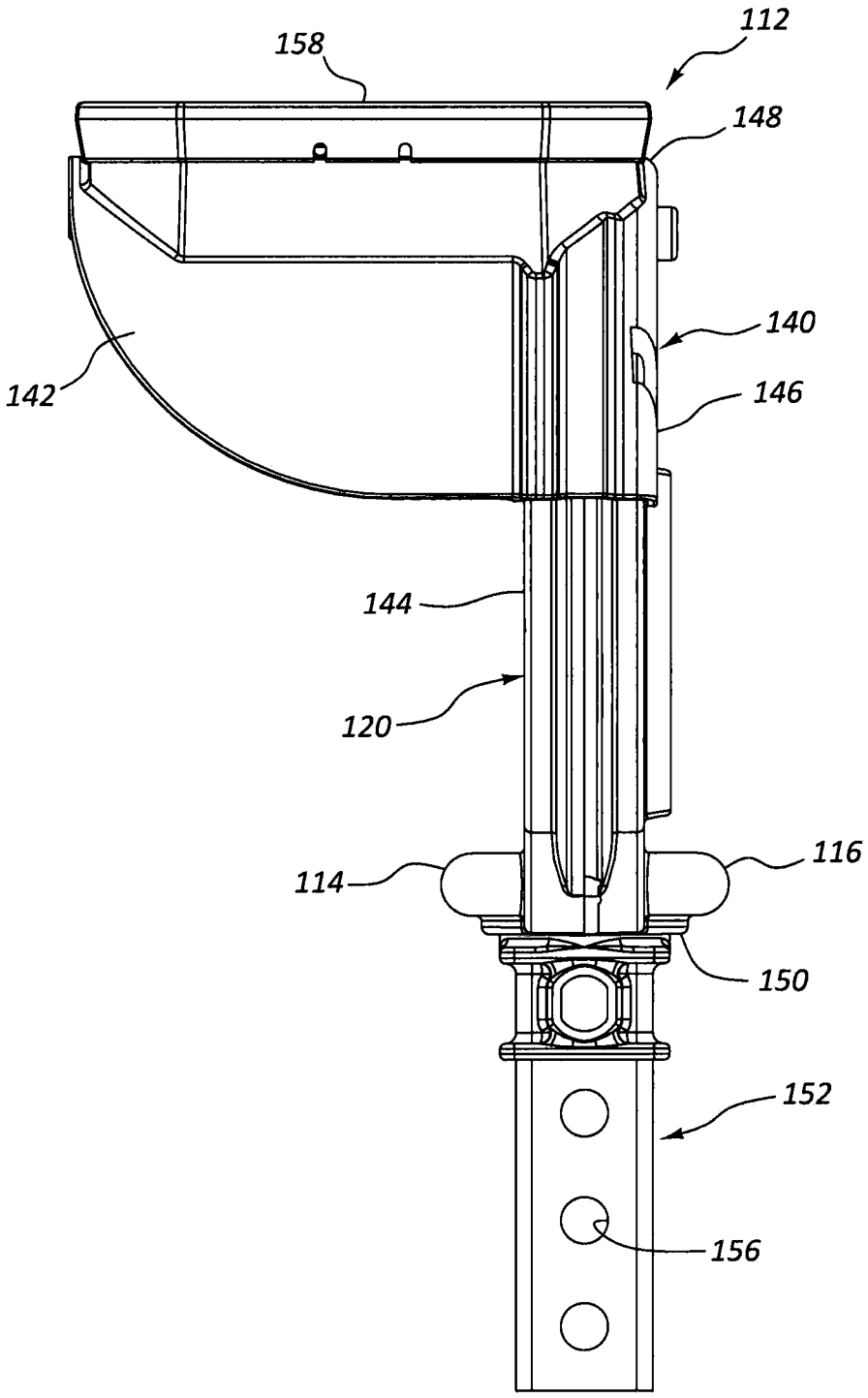
FIG. 11 is a right side view of the barricade light of FIG. 6.
Figure 12:
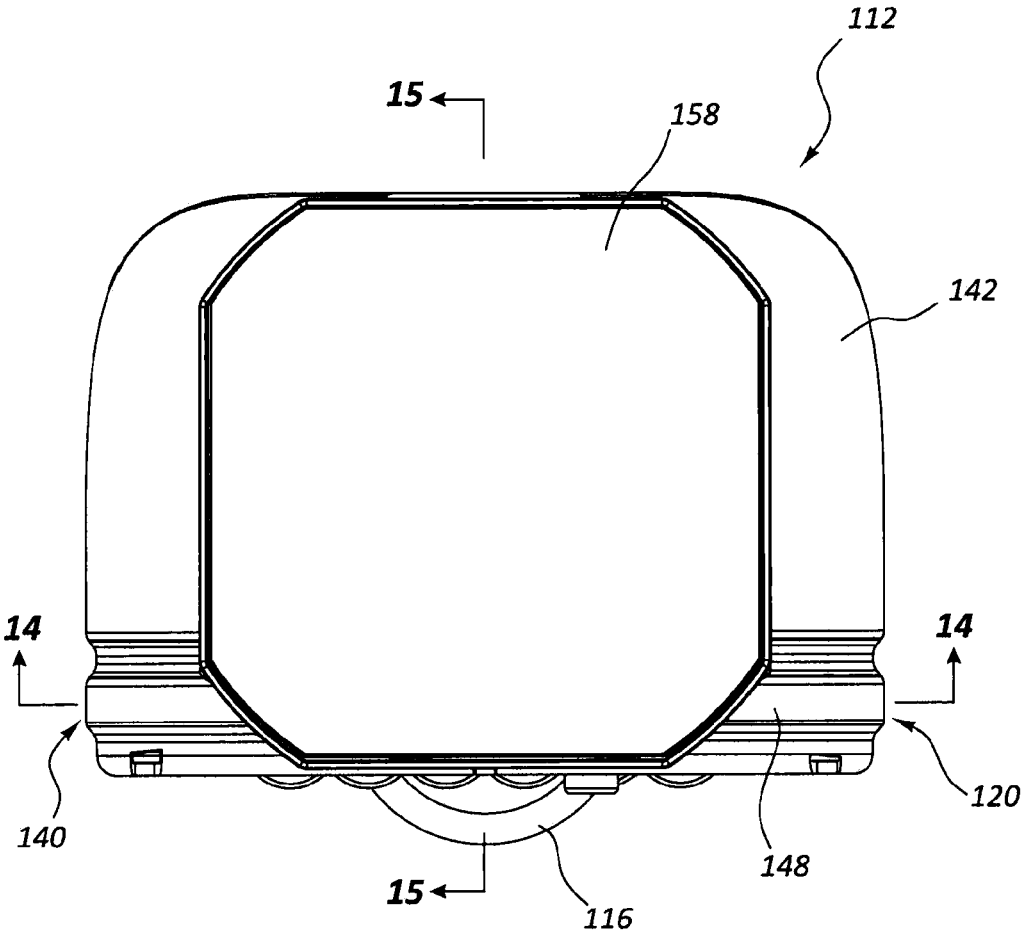
FIG. 12 is a top view of the barricade light of FIG. 6.
Figure 13:
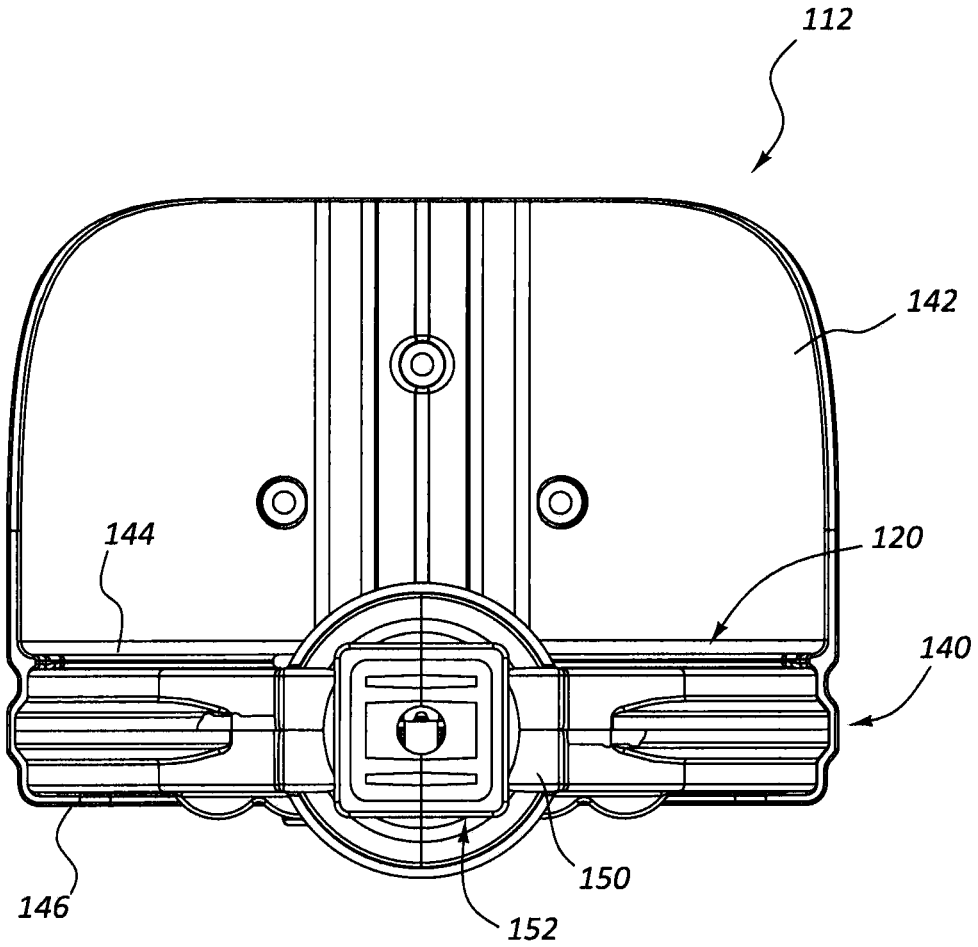
FIG. 13 is a bottom view of the barricade light of FIG. 6.
Figure 14:
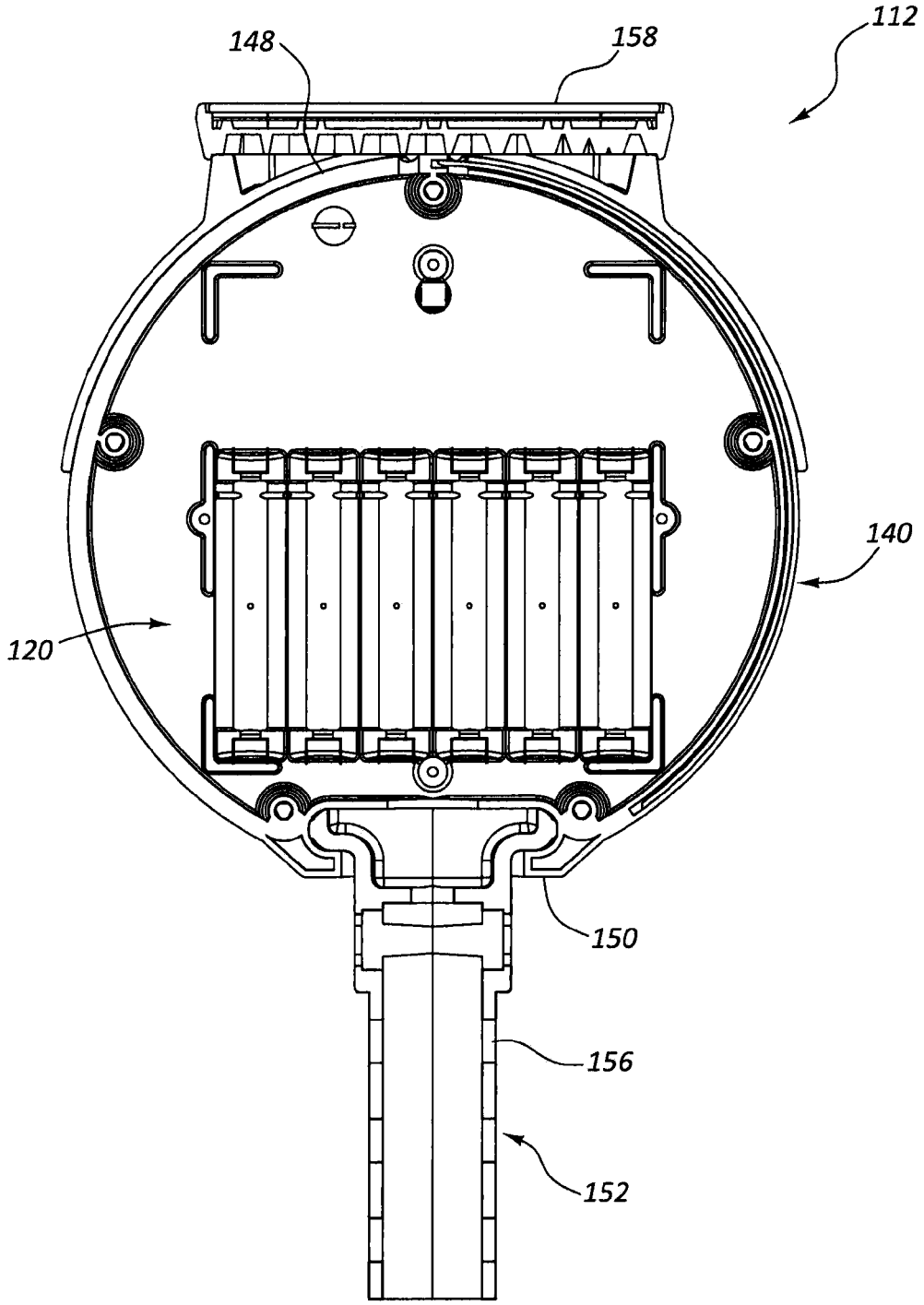
FIG. 14 is a cross-sectional view of the barricade light of FIG. 12 taken along cross-section indicators 14-14.

The barricade lights 112A-112G may be spaced apart a distance X as shown in FIG. 5. A distance X is typically in the range of about 3 ft. to about 100 ft., and more preferably in the range of about 6 ft. to about 60 ft. Each transmitter 116 emits a signal 117 directed down the row of barricade lights. Each of the light devices 120 operates to create a flash of light 121 in a forward direction. In some examples, the light device 120 generates light that is directed in both forward and rearward directions. The light device 120 may comprise at least one light emitting diode (LED) such as a high intensity LED.

The barricade light 112A, upon startup, may go into a search mode in which the receiver 114 searches for signals from other barricade lights. Because the barricade light 112A is the first in the row, no signals will be received by the receiver 114 within a predetermined time (e.g., about 1 second to about 5 seconds). After this predetermined time has elapsed, the controller 118 determines that the barricade light 112A is the first in the row and assigns itself position code 0. The controller 118 prepares a signal for transmission by the transmitter 116 that includes information that the barricade light 112A is in the zero position, which is first in the row. Directly after sending this signal, the controller 118 operates the light device 120 to create a flash of light. As described above, the delay between sending the signal and generating the flash of light may be very small, such as in the range of about 10 milliseconds to about 100 milliseconds, and more preferably about 20 milliseconds to about 40 milliseconds.

The barricade light 112B, upon startup, also initiates a search mode in which the receiver 114 searches for signals from other barricade lights. Since the first barricade light 112A is transmitting signals, the barricade light 112B receives a signal from barricade light 12A, which is the only signal received since there is only one barricade light up the row from barricade light 112B. The control module of the second barricade light 112B determines it is second in the row and assigns itself position code 1. The control module waits receive a second signal from the first barricade light 112A, which confirms the position of barricade light 112B as second in the row. The controller uses the second signal to synchronize its own light flash with that of the first barricade light 112A. The control module of the second barricade light 112B may wait a predetermined time period, such as, for example, ⅙ of a second, and sends a signal via transmitter 116 with information that the barricade light 112B is second in the row, and then operates the light device 120 to create a flash of light. The delay between sending the signal and generating the flash of light may be, for example, about 20 milliseconds to about 40 milliseconds.

The third barricade light 112C, upon startup, searches for signals and receives signals from both of the first and second barricade lights 112A, 112B. The controller 118 identifies the signal from the barricade light 112B as being the higher position (e.g., the second position in the row with position code 1) and then assigns itself position code 2. The controller waits to receive a second signal from the second barricade light 112B to confirm the position of barricade light 112C as third in the row and uses that second signal to synchronize generation of a flash with the light device 120. Just before generating the flash, which may occur after a delay of about, for example, ⅙ of a second from receiving the second signal from the second barricade light 112B, the controller 118 sends a signal via transmitter 116 with information that the barricade light 112C is the third in the row (e.g., position code 2).

The same sequence of processing steps occurs for each of the remaining barricade lights 112D-112G. If any one of the barricade lights 112A-112G becomes nonfunctional or is removed from or added to the row, the controller 118 of barricade lights down the row automatically updates a position of the barricade light on a second-by-second basis, updates its own position in the row, resynchronizes its flash accordingly, and transmits a signal with the updated position information so that those barricade lights down the row may also update their position and resynchronize their light flash.

The example barricade lights disclosed herein may include functionality that provides digital masking of noise and improperly received signals. In one scenario, a signal transmitted by a transmitter may reflect off of two or more surfaces so that the signal is inadvertently received by a receiver of a barricade light up the row of barricade lights. Typically, the intensity of this inadvertently-received signal and the timing of its receipt identify the signal as an inadvertently received signal that is to be ignored. For example, if the unintentional signal is received at an interval that does not match a ⅙ of a second interval, or the unintentional signal is not repeated consistently, the digital masking may provide disregard of that signal.

In one example, the position codes assigned to the barricade lights may range from 0 to any desired level, such as about 15. After a position code of 15 is reached, the next higher number assigned by the next barricade light down the row would be 1, since zero is typically only assigned to the very first barricade light in the entire row. The sequencing function of the row of barricade lights may be operable for any number of barricade lights in a row. For example, the sequencing may be possible for 2-3 barricade lights or up to 500 barricade lights.

The power source for the barricade lights may come from a variety of sources. In one example, the power source is a rechargeable battery such as a lithium iron phosphate (LiFePO) battery. The battery may be charged using, for example, a solar panel mounted to the barricade light. In other examples, as will be described below, replaceable batteries may be carried in a battery housing attached to the barricade light. In still further examples, the barricade lights are wired to a large battery that is positioned remote from the barricade lights and is attached to, for example, a plurality of barricade lights.

Referring now to FIGS. 6-15, the barricade light 112 described with reference to FIGS. 4 and 5 is shown and described in further detail. The barricade light 112 includes a receiver 114, a transmitter 116, a controller 118, and a light device 120. The light device 120 may include a light housing 140 having a front 144, a rear 146, a top 148, a bottom 150, and a visor 142. A support stand 152 may extend from the bottom 150 and include a plurality of fastener apertures 156. A solar panel 158 may be positioned at the top 148. The solar panel 158 may rest on top of the visor 142. The visor 142 may help direct light generated by the light device 120 in a forward, horizontal direction. The visor 142 may provide some shading for the light device 120 to increase visibility during high ambient light conditions.

The receiver 114 is positioned on the front 144. The transmitter 116 is positioned on the rear 146. The receiver 114 and transmitter 116 typically face in opposite directions. In alternative embodiments, an additional transmitter or receiver is added at other positions on the barricade light to transmit or receive information with other barricade lights inside or outside of those barricade lights in the row.

Figure 15:
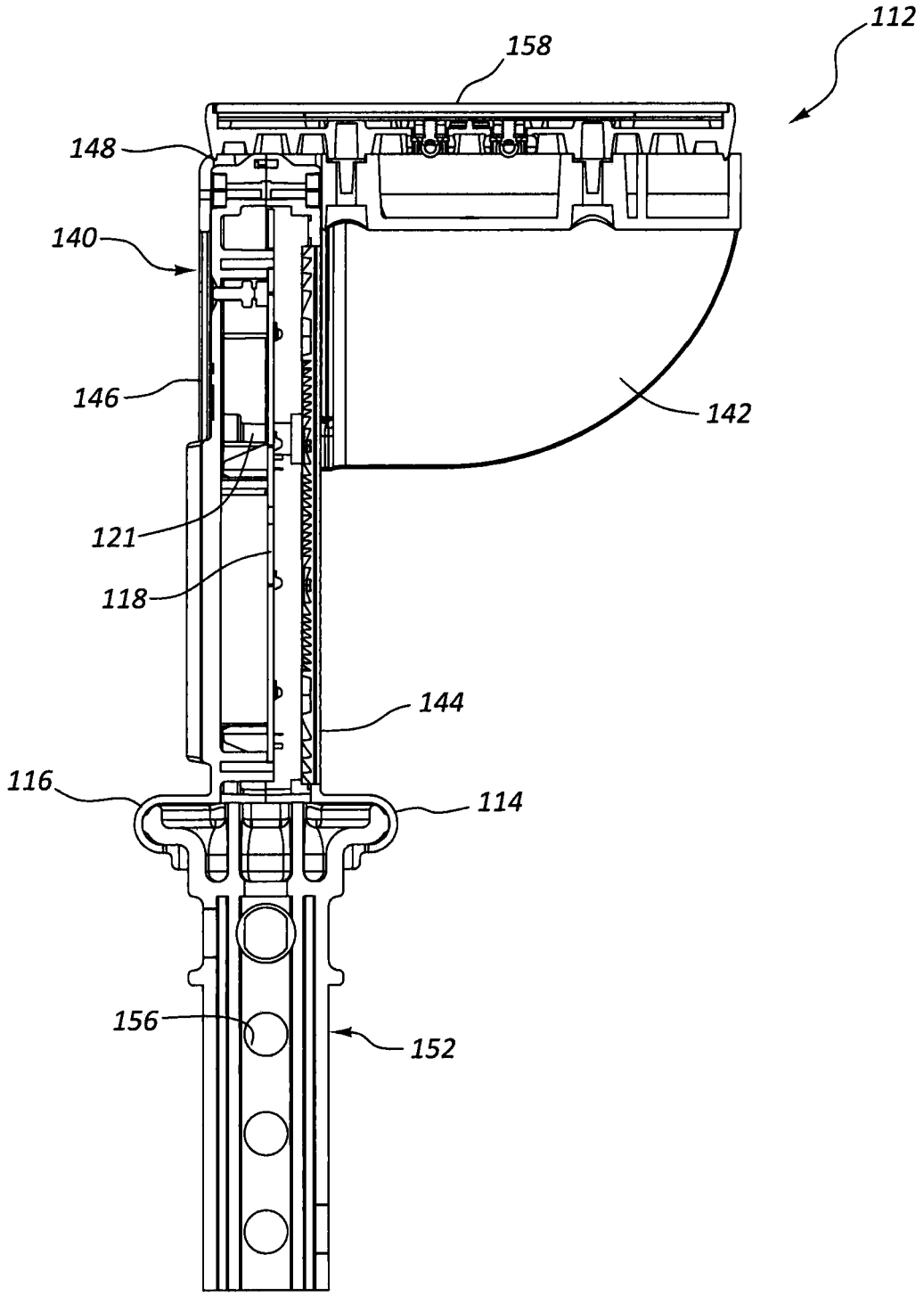
FIG. 15 is a cross-sectional view of the barricade light of FIG. 12 taken along cross-section indicators 15-15.
Figure 16:
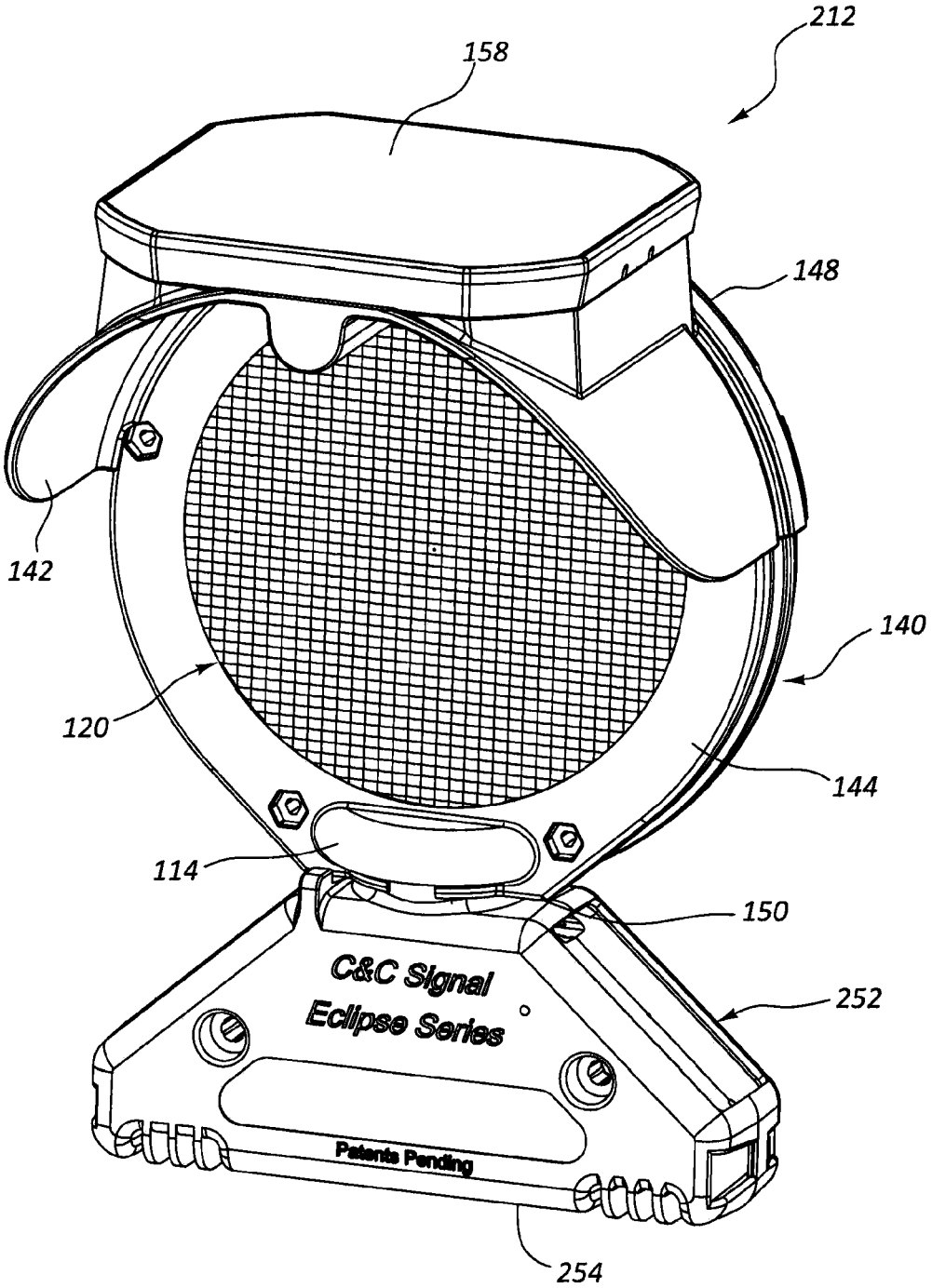
FIG. 16 is a perspective view of another example barricade light in accordance with the present disclosure.
Figure 17:
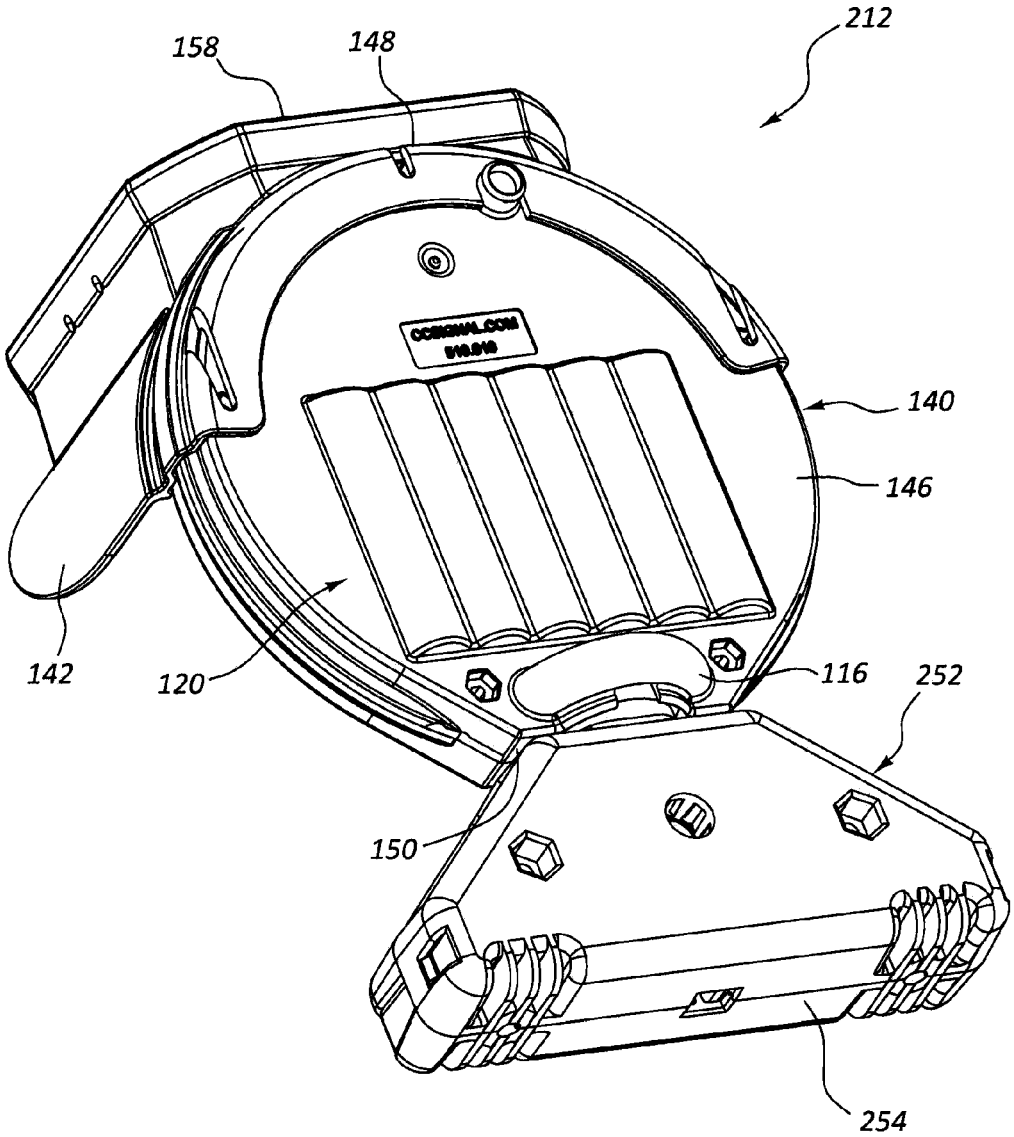
FIG. 17 is another perspective view of the barricade light shown in FIG. 16.
Figure 18:
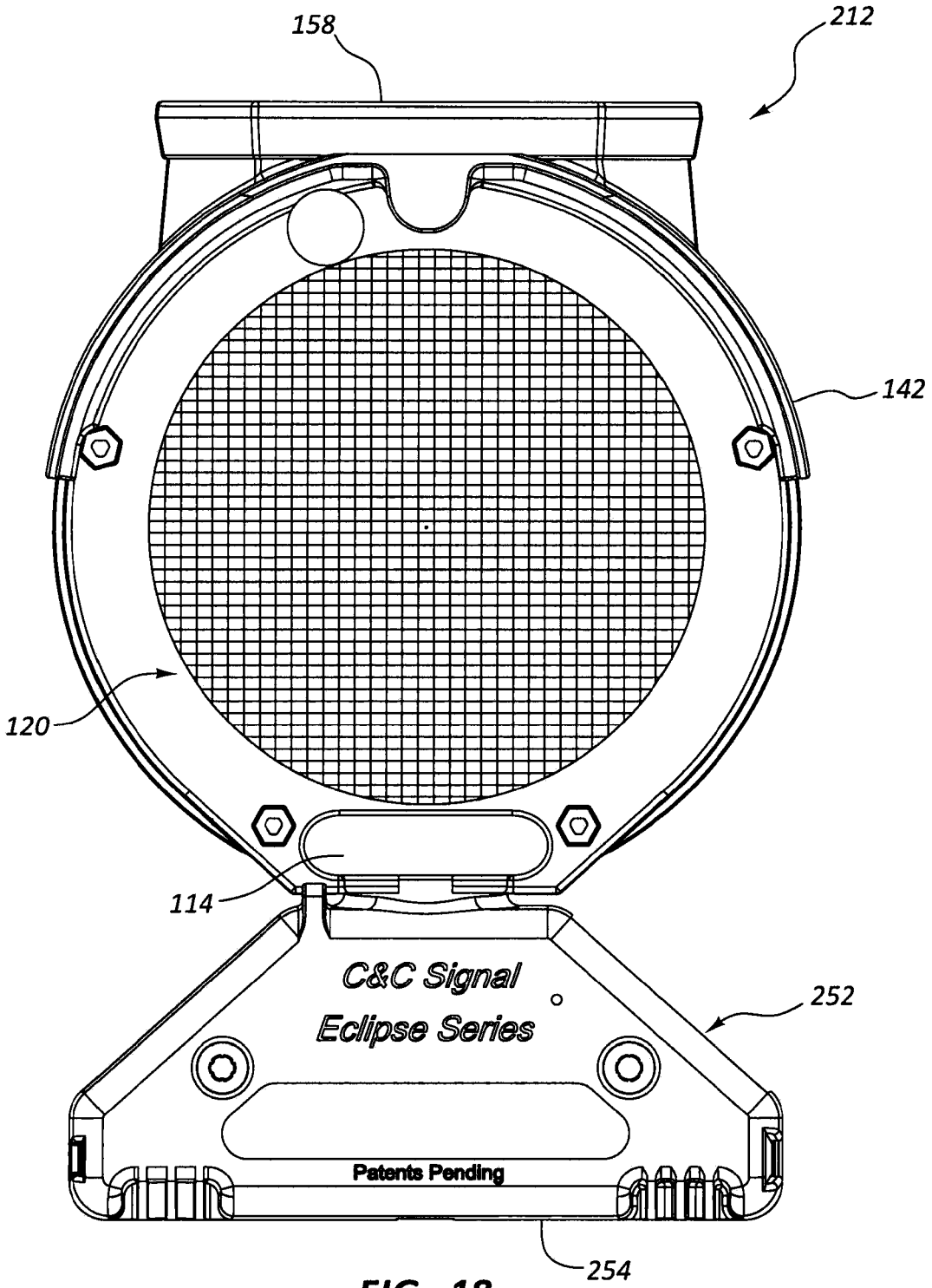
FIG. 18 is a front view of the barricade light of FIG. 16.

FIG. 15 shows the controller 118 positioned within the light housing 140. A light 121 may also be positioned within the light housing 140 and generate light that is directed in a forward direction. The controller 118 may include a microprocessor and may be mounted to a printed circuit board. The receiver 114 and transmitter 116, as well as the light device 120, are electrically coupled to the controller 118. A power source such as, for example, the solar panel 158 may also be coupled to the controller 118 and other features of the barricade light 112.

The support stand 152 may be constructed as a post feature that is insertable into or over a support structure such as a barricade. The fastener apertures 156 may be sized and arranged to receive a fastener such as a removable pin that provides a positive connection of the barricade light 112 to the support structure. The support structure may include, for example, a barricade such as barricades 102 shown in FIG. 4, a vehicle, or a piece of equipment.

Referring now to FIGS. 16-25, another example barricade light 212 is shown including a different support stand 252 having a support surface 254. The remaining features of barricade light 212 may be the same or similar to the features of barricade light 112 described above.

The support stand 252 may be designed for insertion into a support structure such as, for example, a recess in a panel portion of a barricade. The support stand 252 may provide a snap-fit connection or interference-fit connection with the support structure. The support stand 252 may be substantially hollow, or may house other features such as at least on battery.

Figure 19:
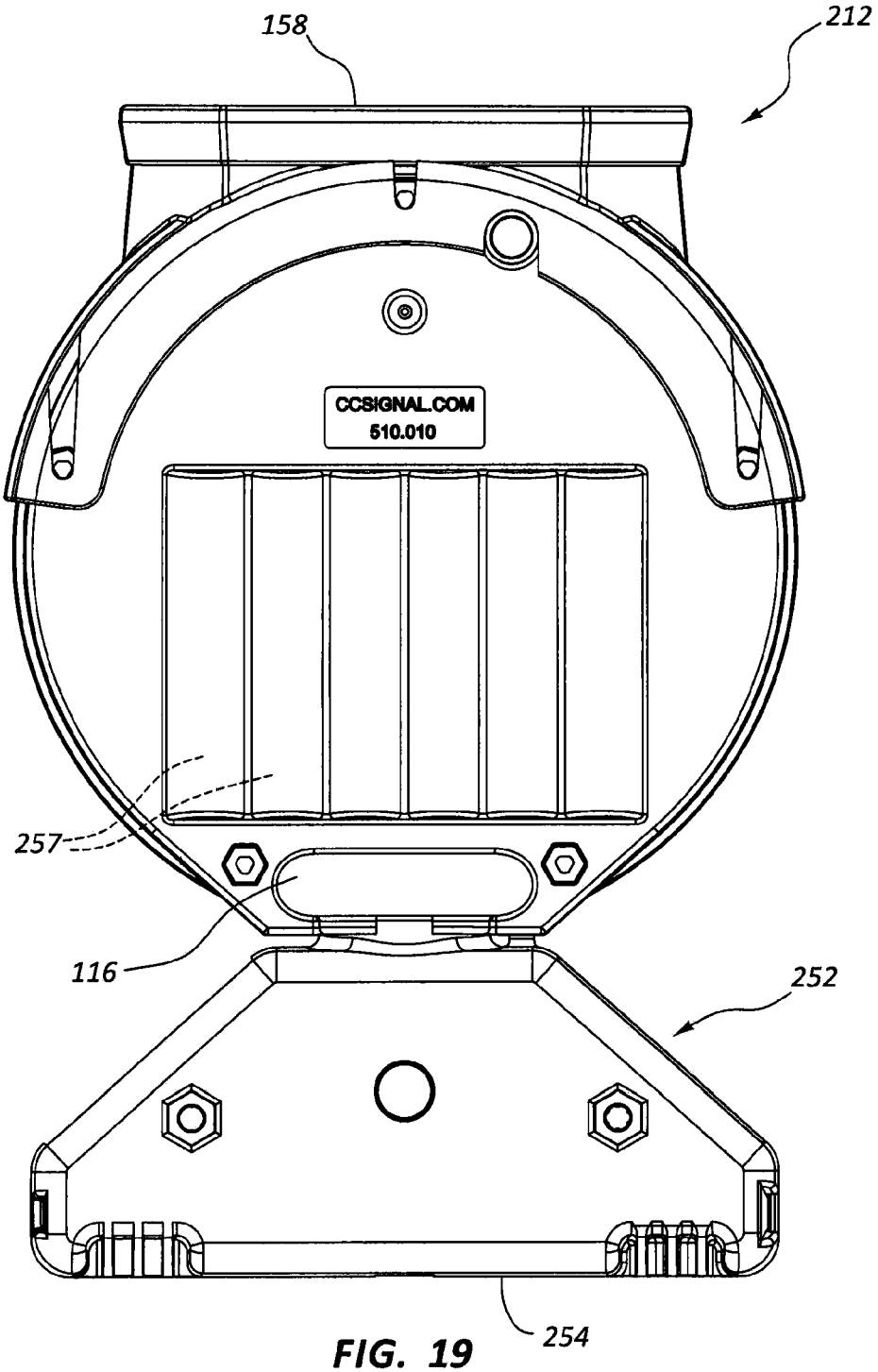
FIG. 19 is a rear view of the barricade light of FIG. 16.
Figure 20:
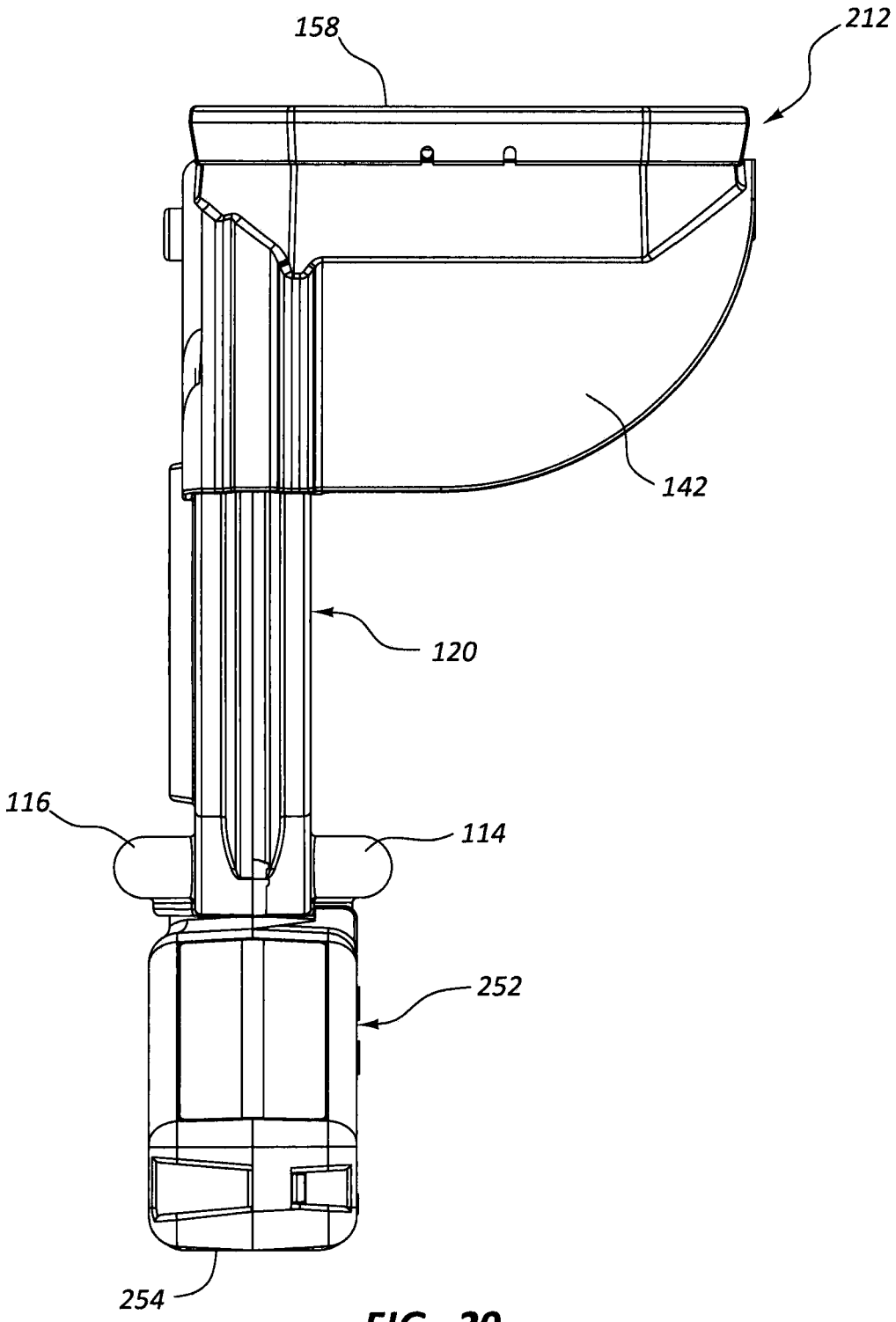
FIG. 20 is a left side view of the barricade light of FIG. 16.
Figure 21:
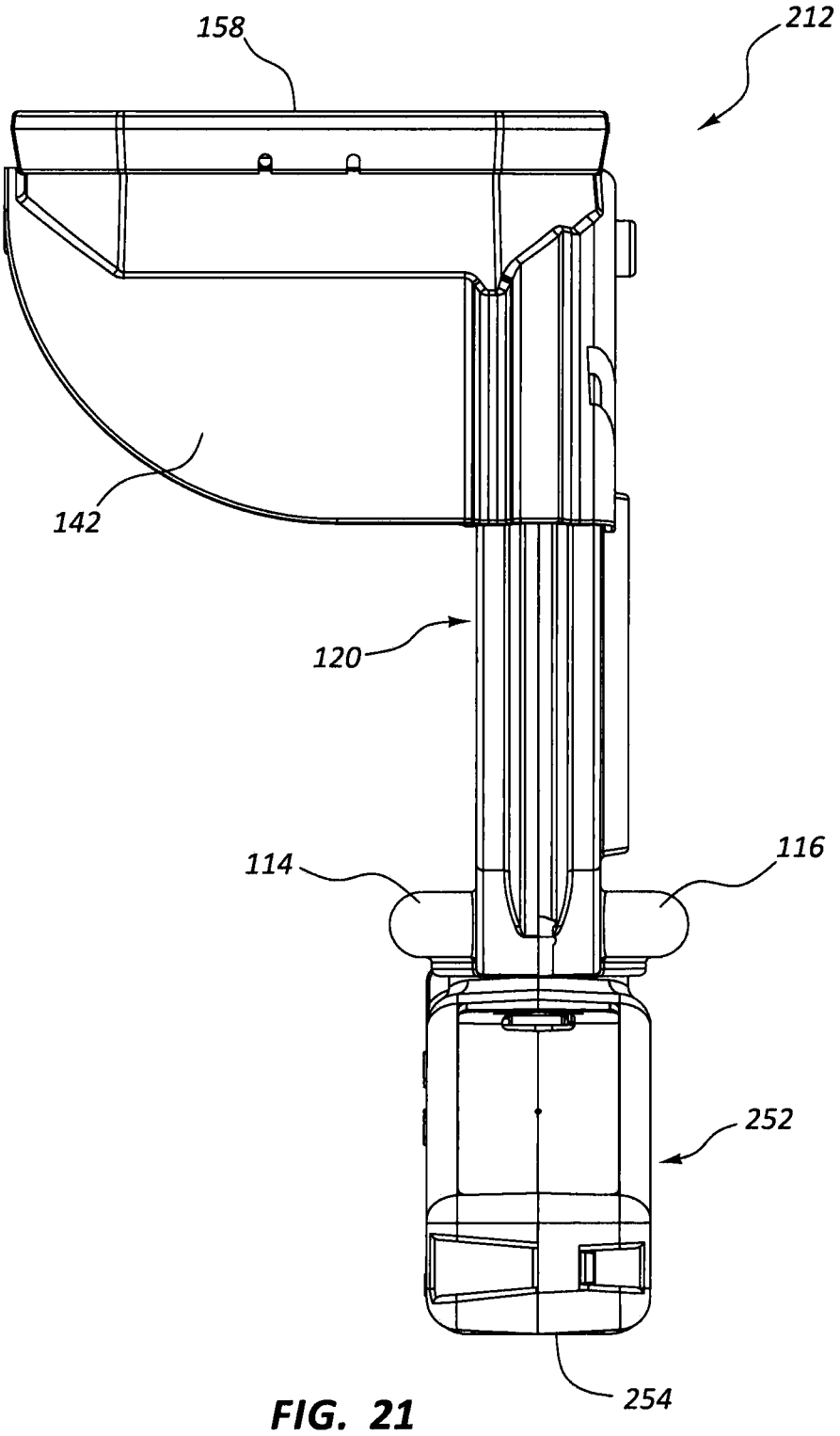
FIG. 21 is a right side view of the barricade light of FIG. 16.
Figure 22:
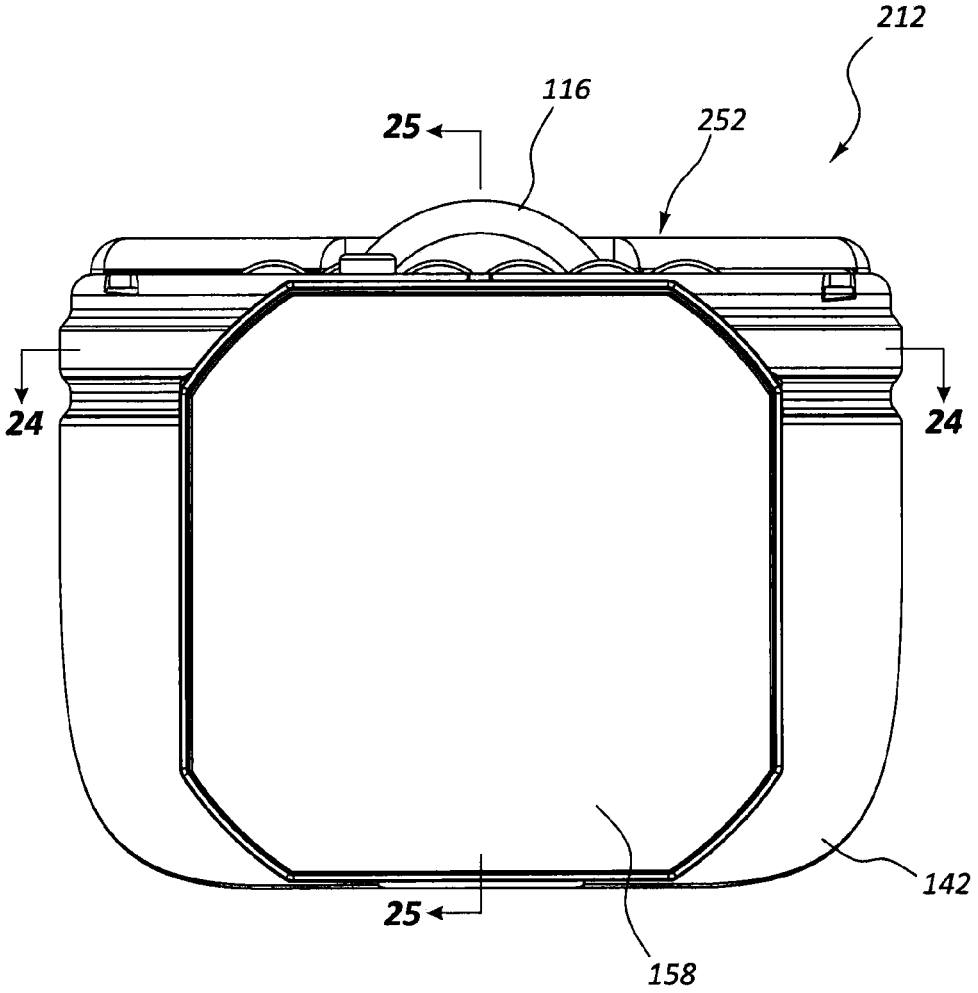
FIG. 22 is a top view of the barricade light of FIG. 16.
Figure 23:
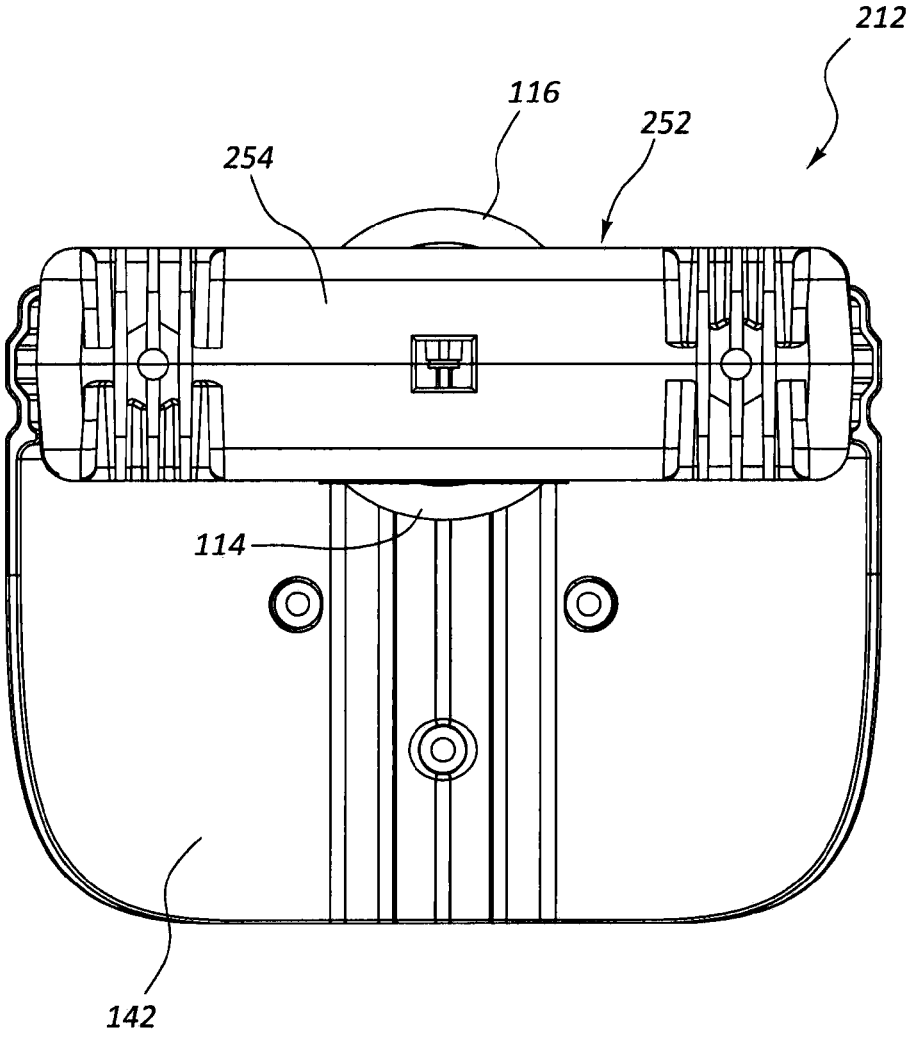
FIG. 23 is a bottom view of the barricade light of FIG. 16.
Figure 24:
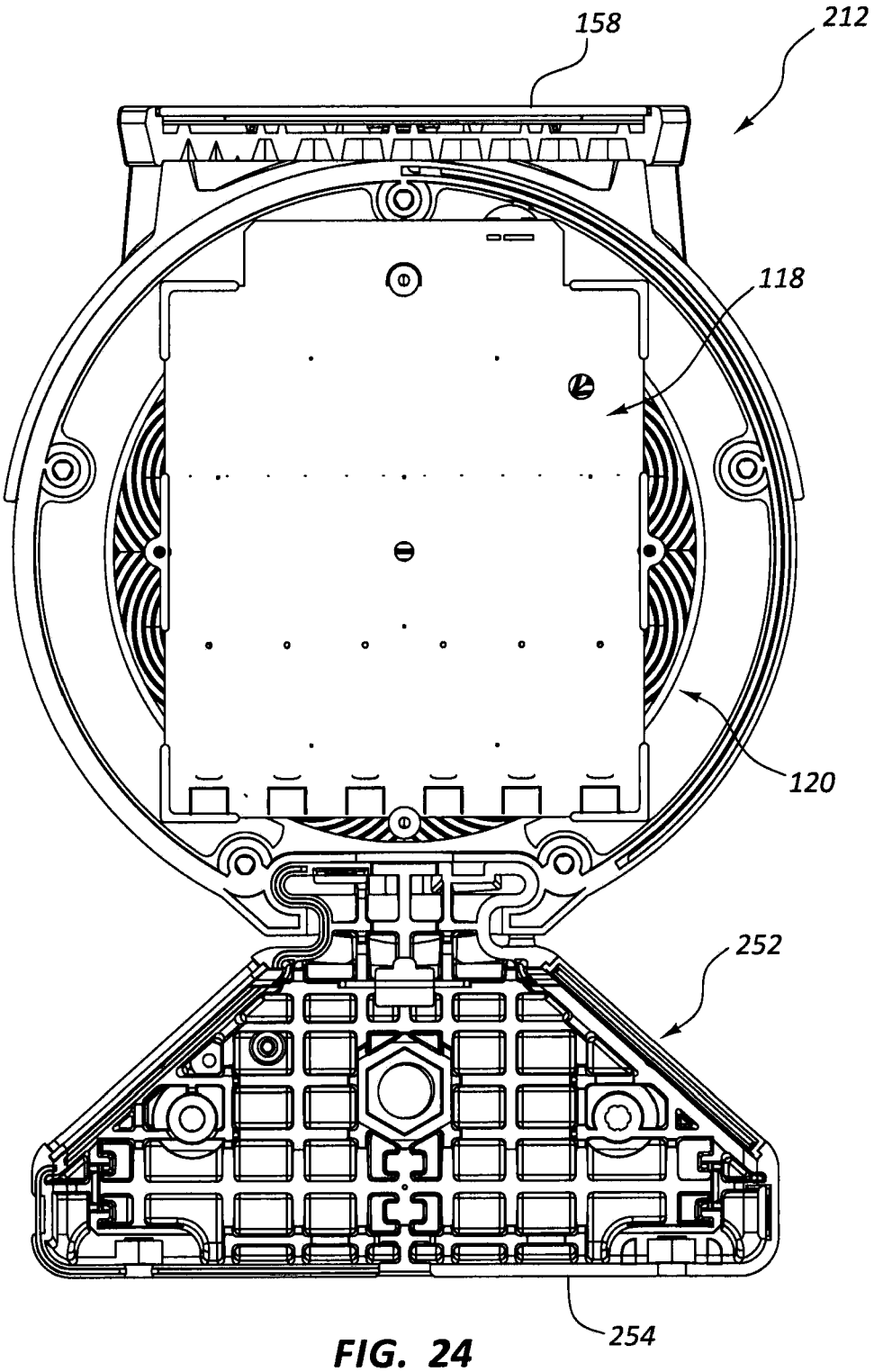
FIG. 24 is a cross-sectional view of the barricade light of FIG. 22 taken along cross-section indicators 14-14.
Figure 25:
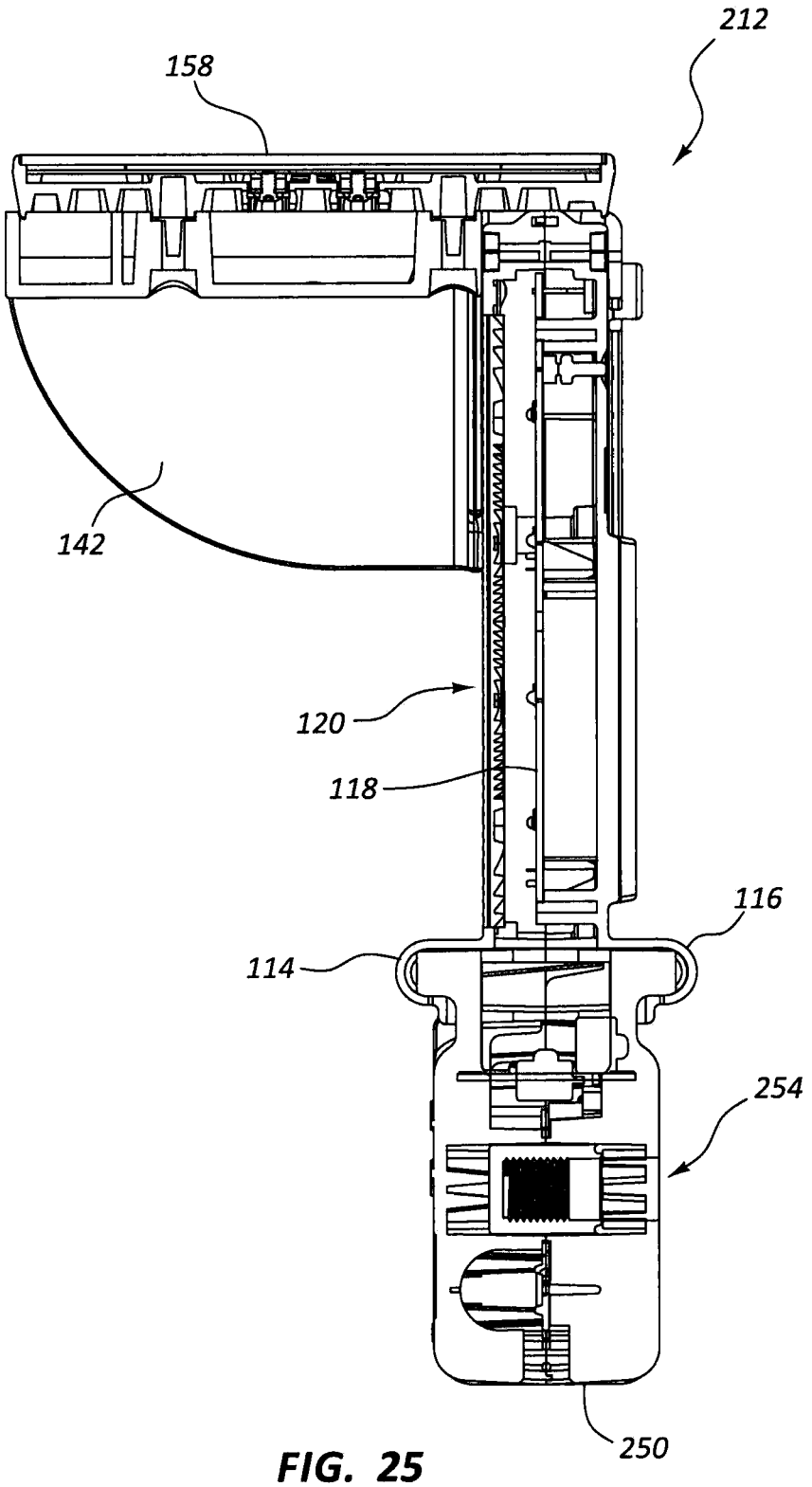
FIG. 25 is a cross-sectional view of the barricade light of FIG. 22 taken along cross-section indicators 15-15.
Figure 26:
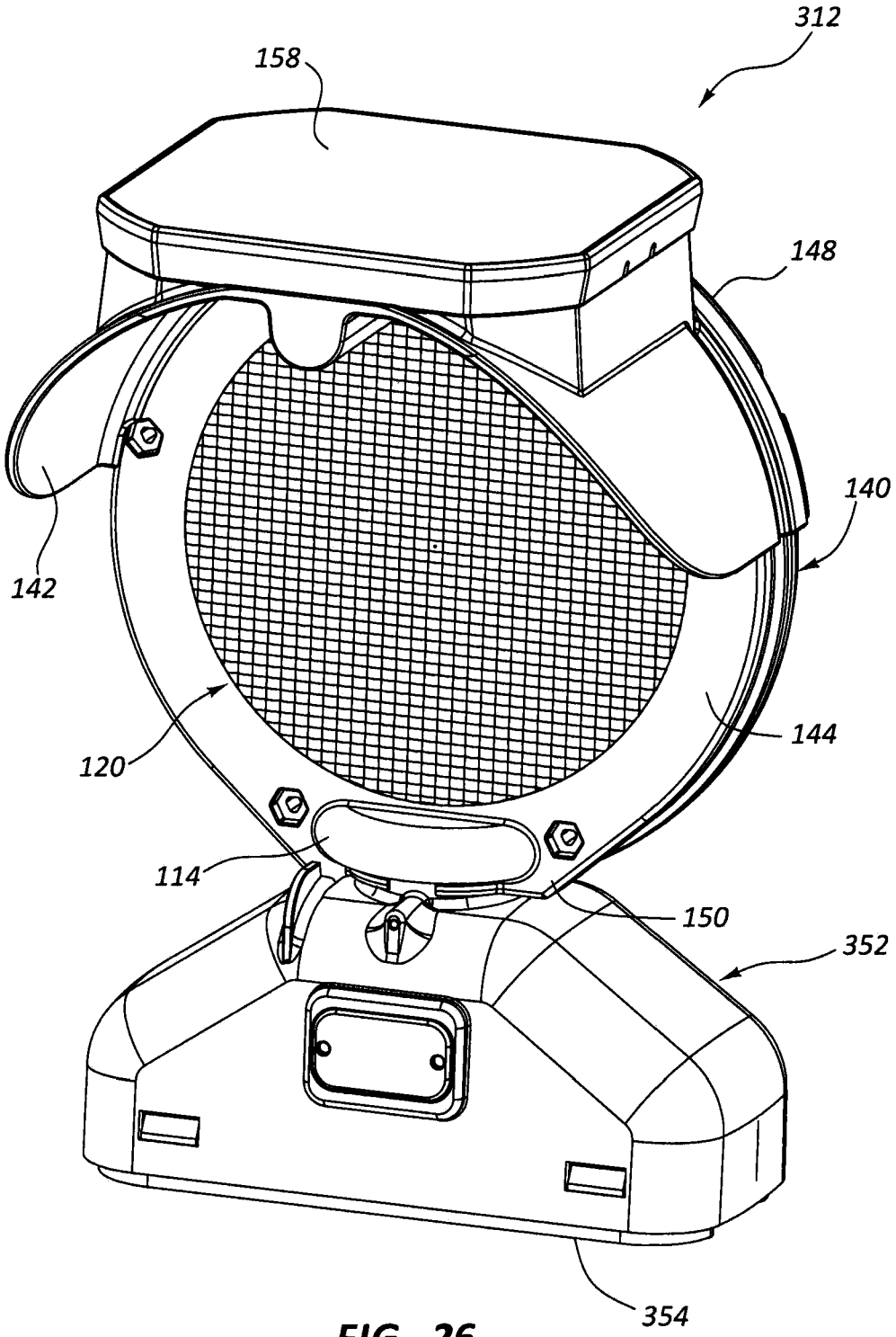
FIG. 26 is a perspective view of another example barricade light in accordance with the present disclosure.
Figure 27:
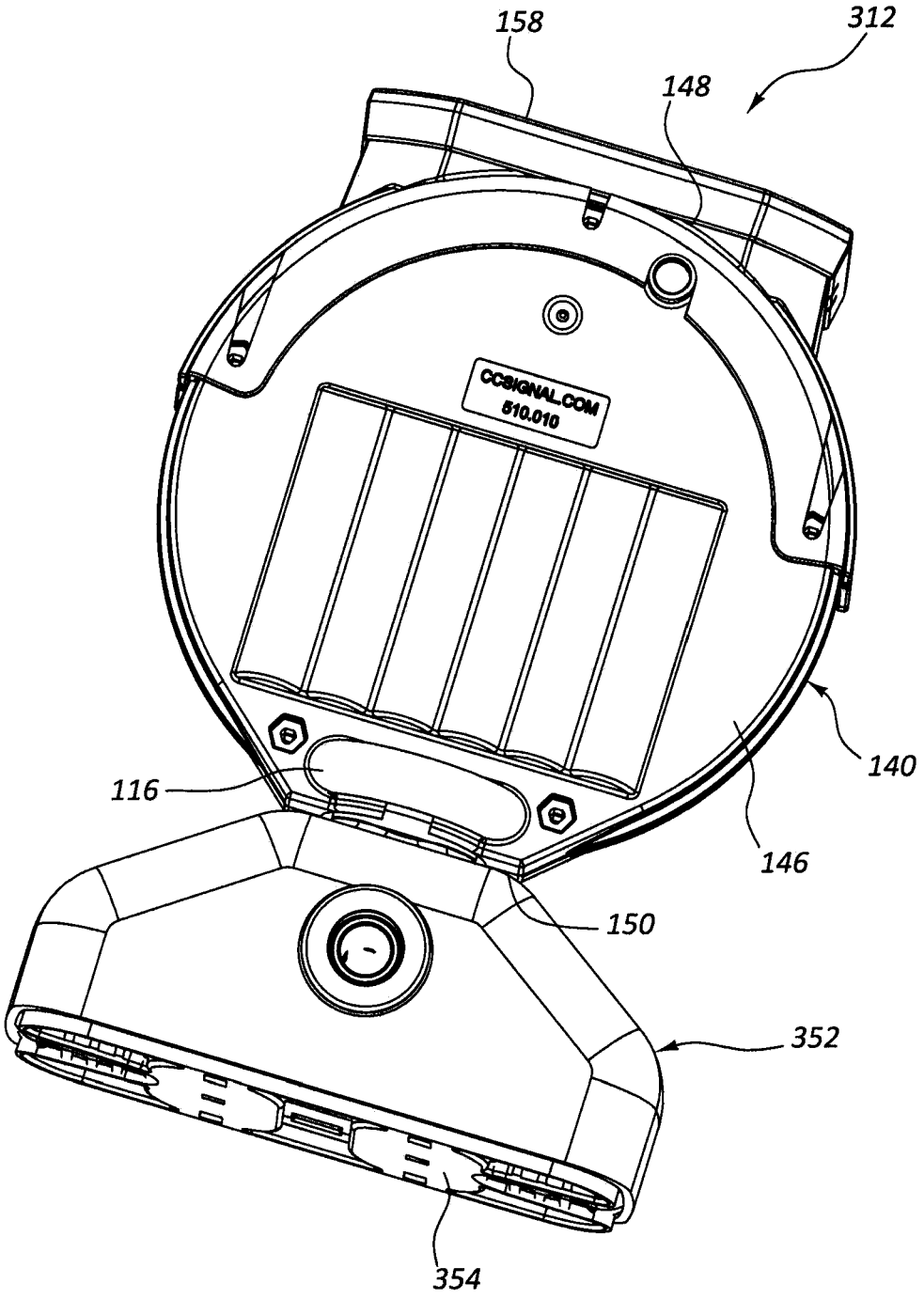
FIG. 27 is another perspective view of the barricade light shown in FIG. 26.
Figure 28:
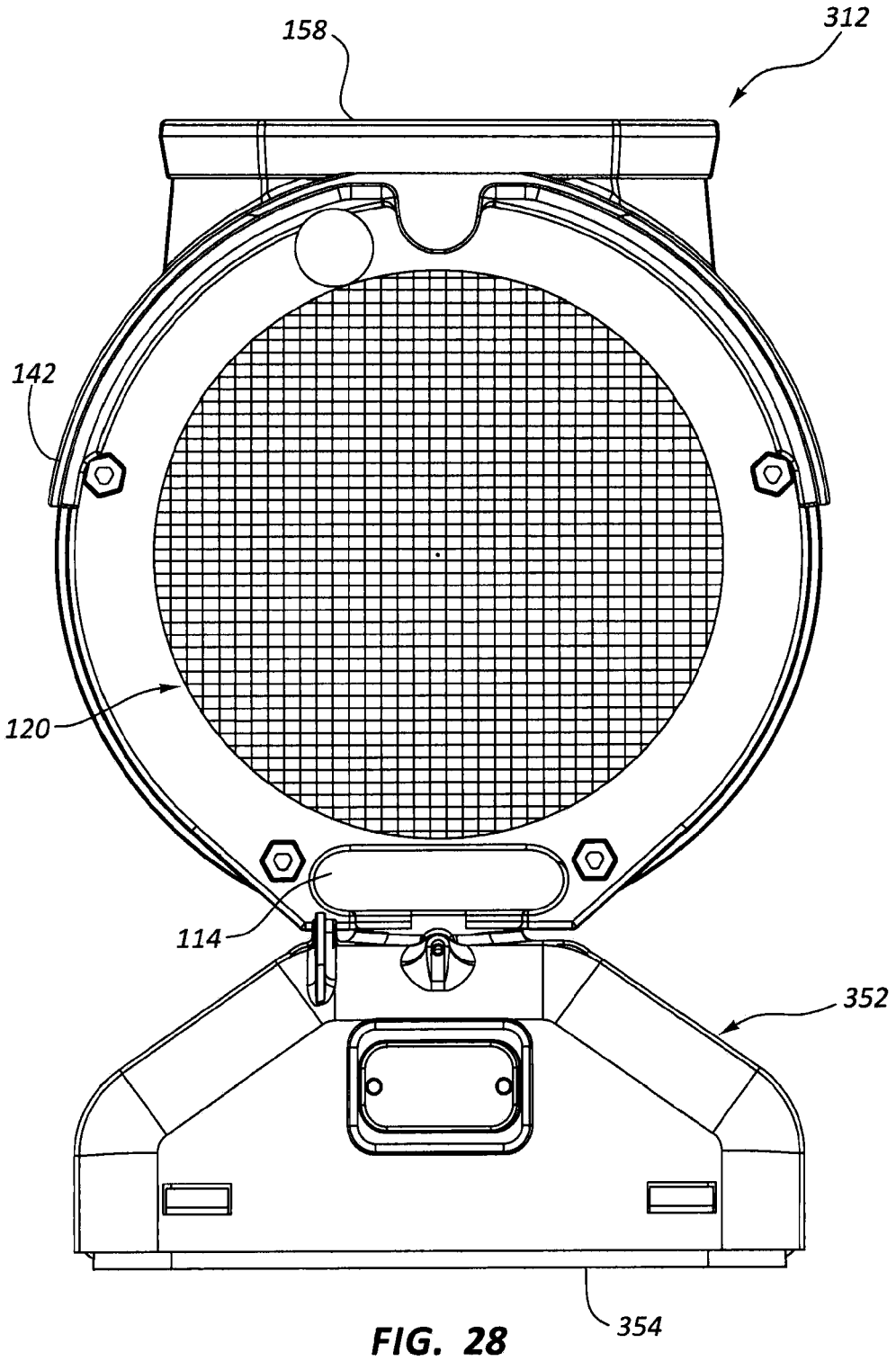
FIG. 28 is a front view of the barricade light of FIG. 26.
Figure 29:
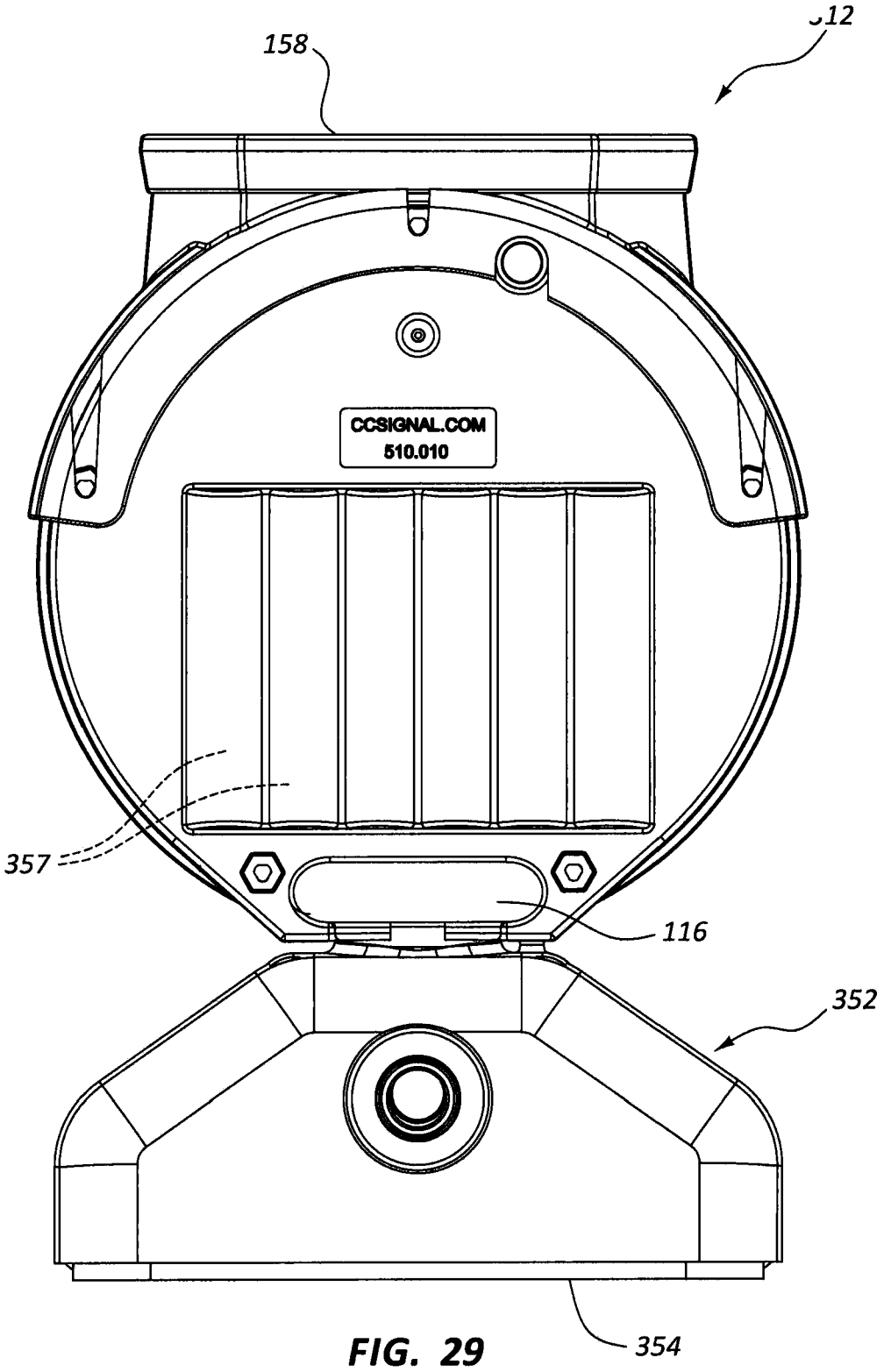
FIG. 29 is a rear view of the barricade light of FIG. 26.
Figure 30:
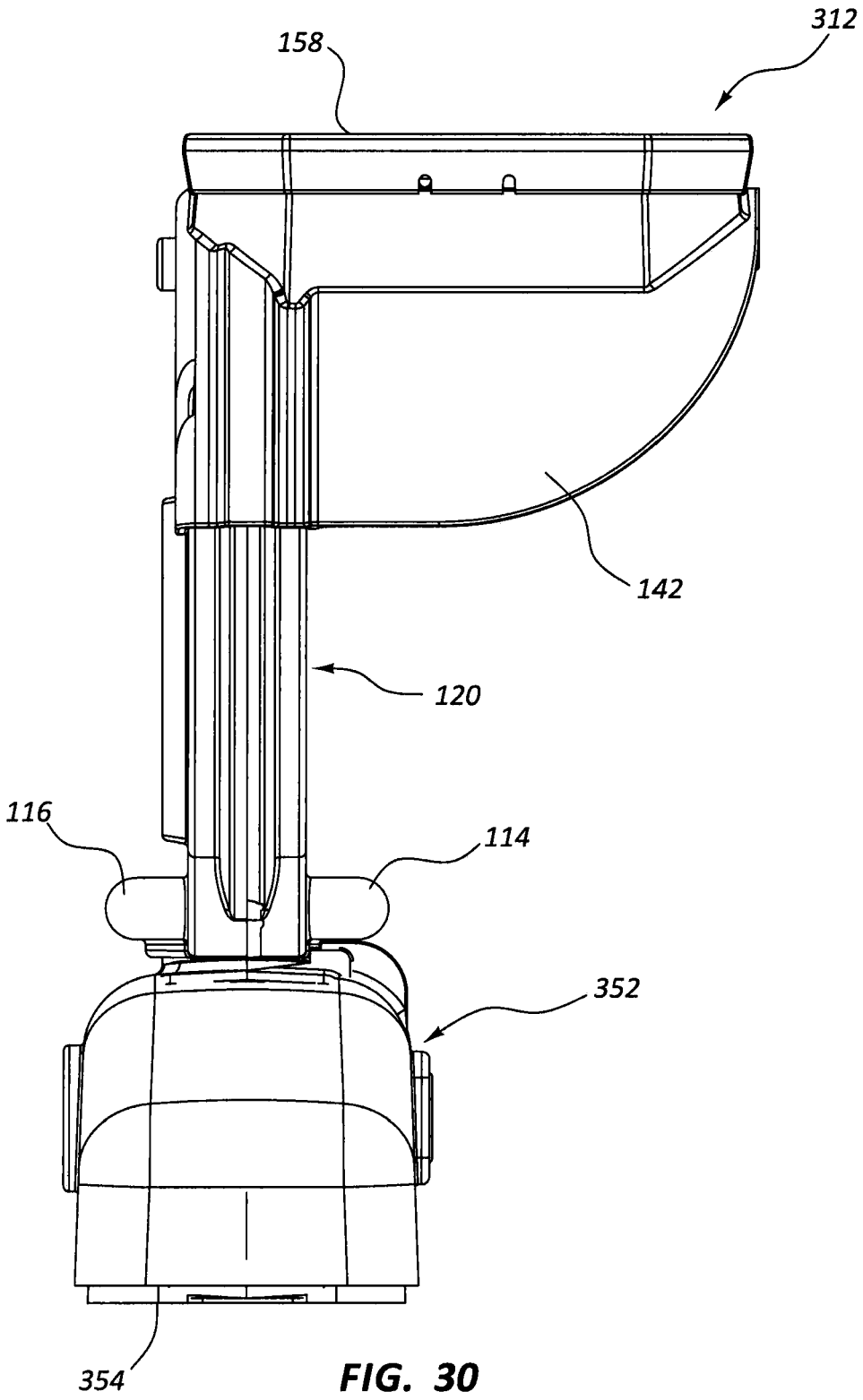
FIG. 30 is a left side view of the barricade light of FIG. 26.
Figure 31:
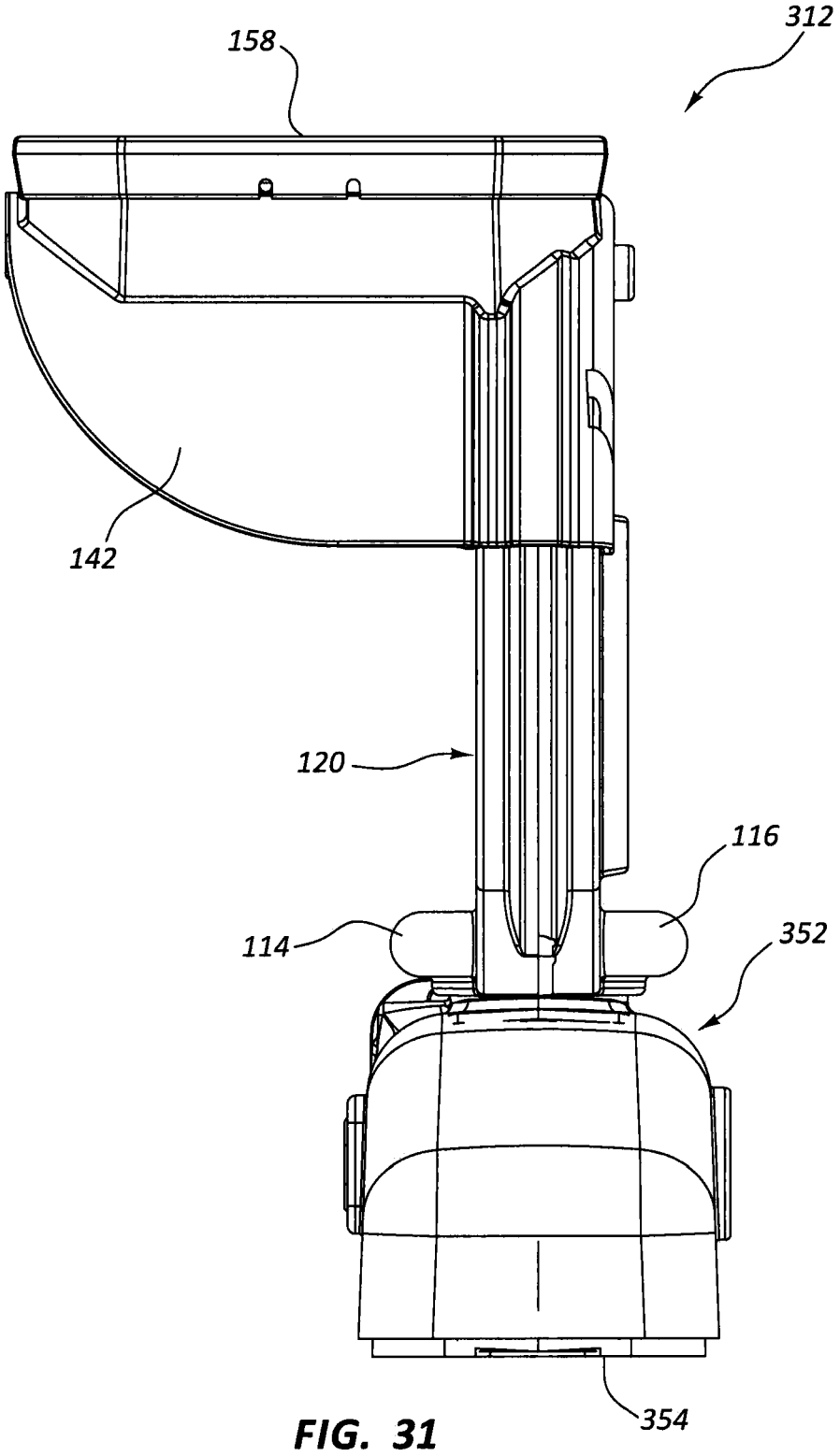
FIG. 31 is a right side view of the barricade light of FIG. 26.
Figure 32:
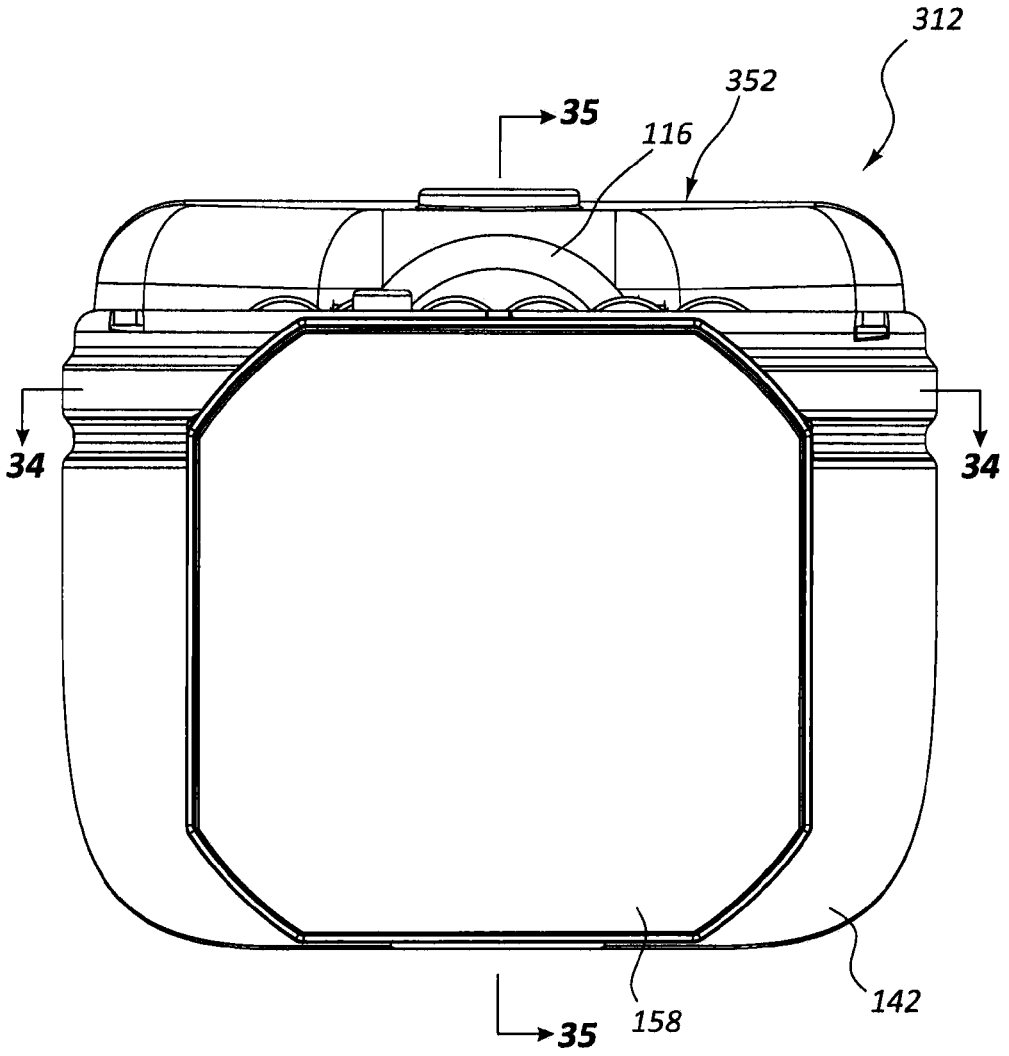
FIG. 32 is a top view of the barricade light of FIG. 26.
Figure 33:
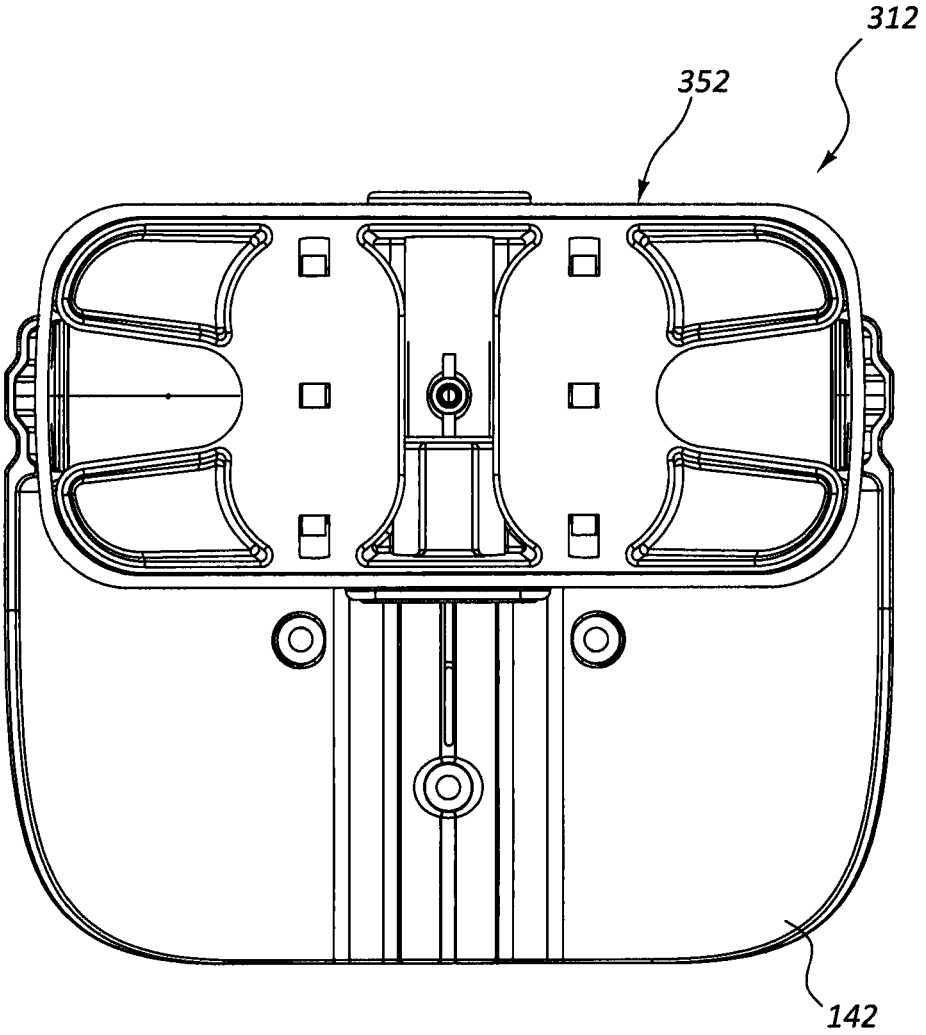
FIG. 33 is a bottom view of the barricade light of FIG. 26.
Figure 34:
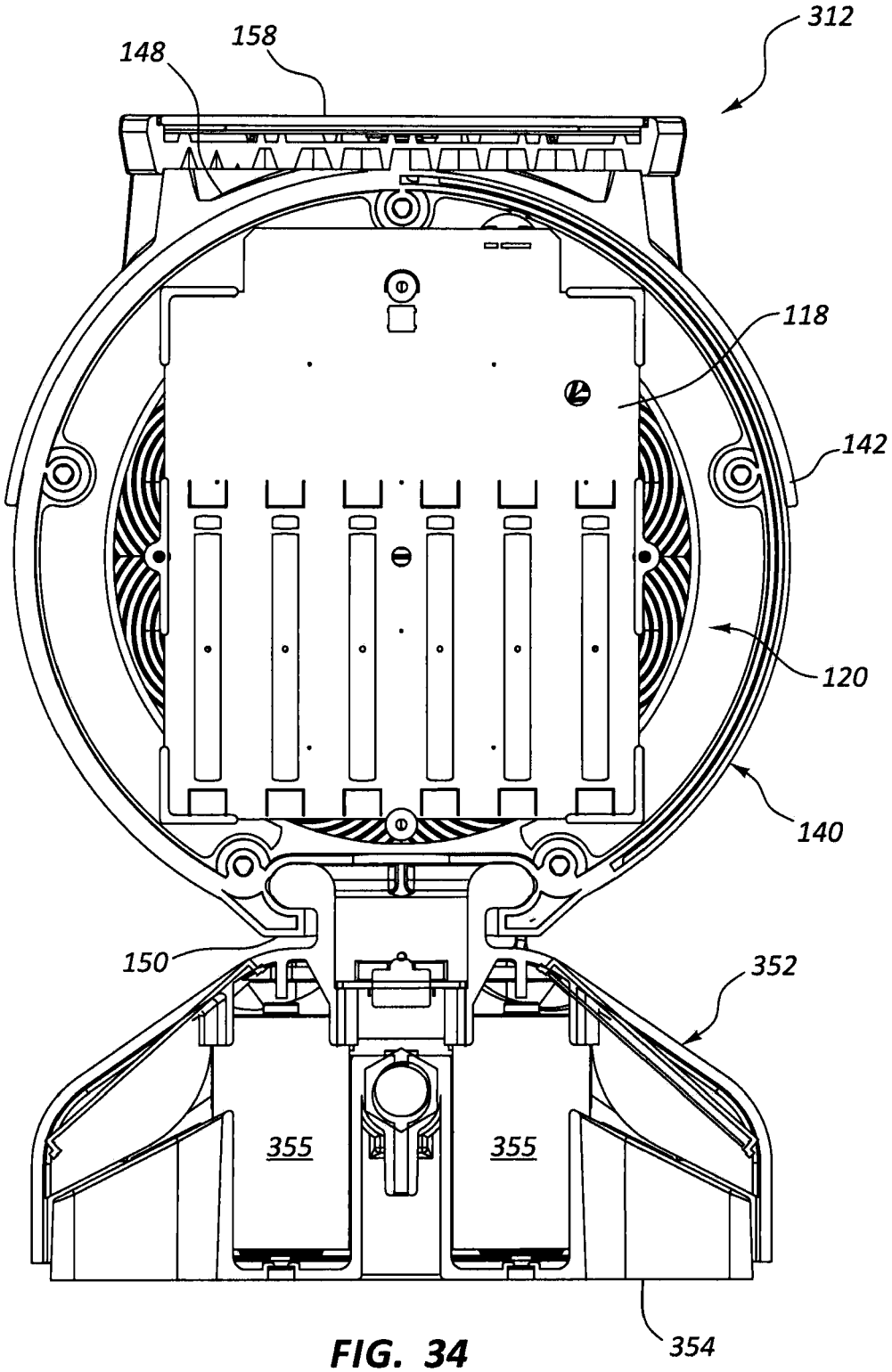
FIG. 34 is a cross-sectional view of the barricade light of FIG. 32 taken along cross-section indicators 14-14.
Figure 35:
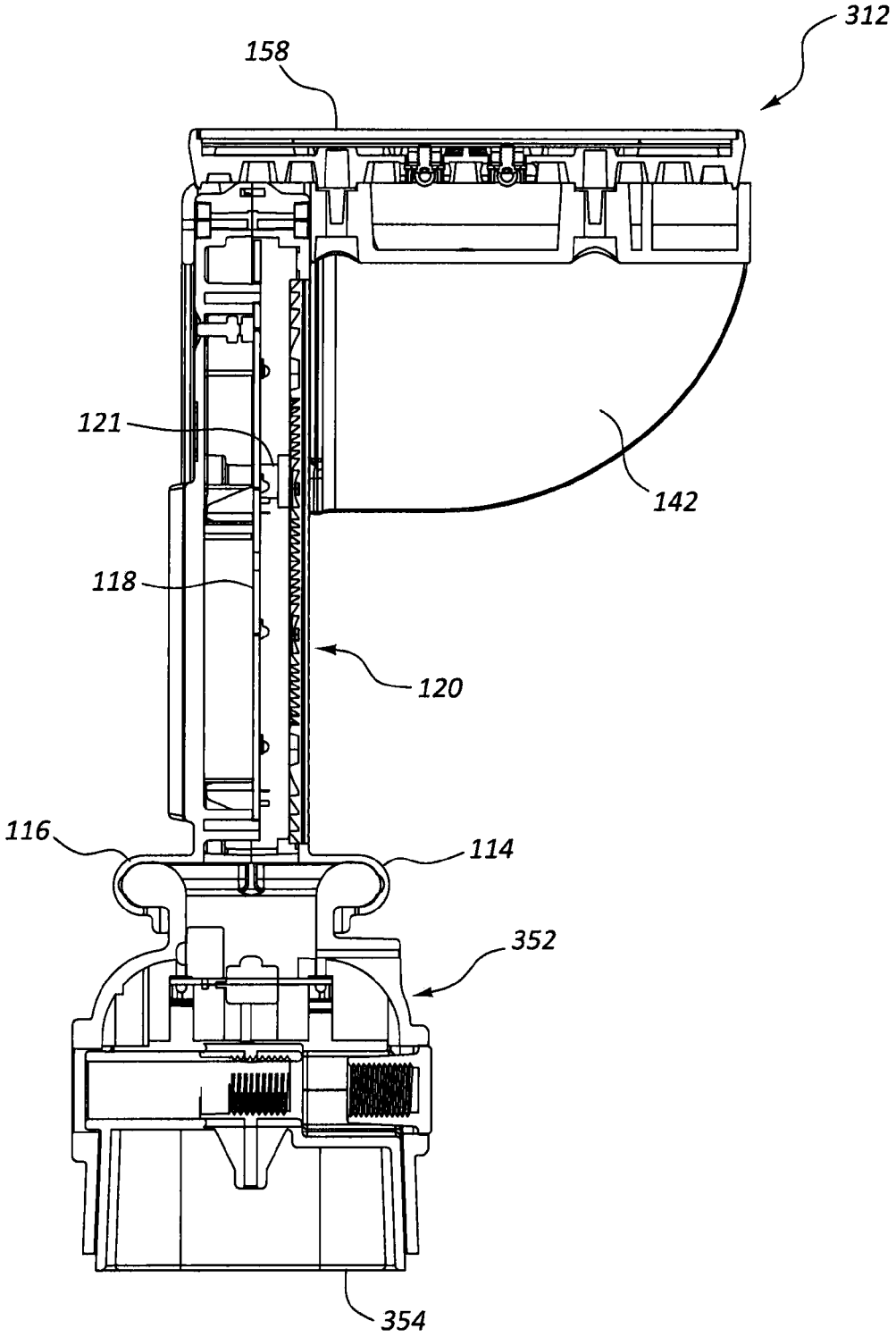
FIG. 35 is a cross-sectional view of the barricade light of FIG. 32 taken along cross-section indicators 15-15.
Figure 36:
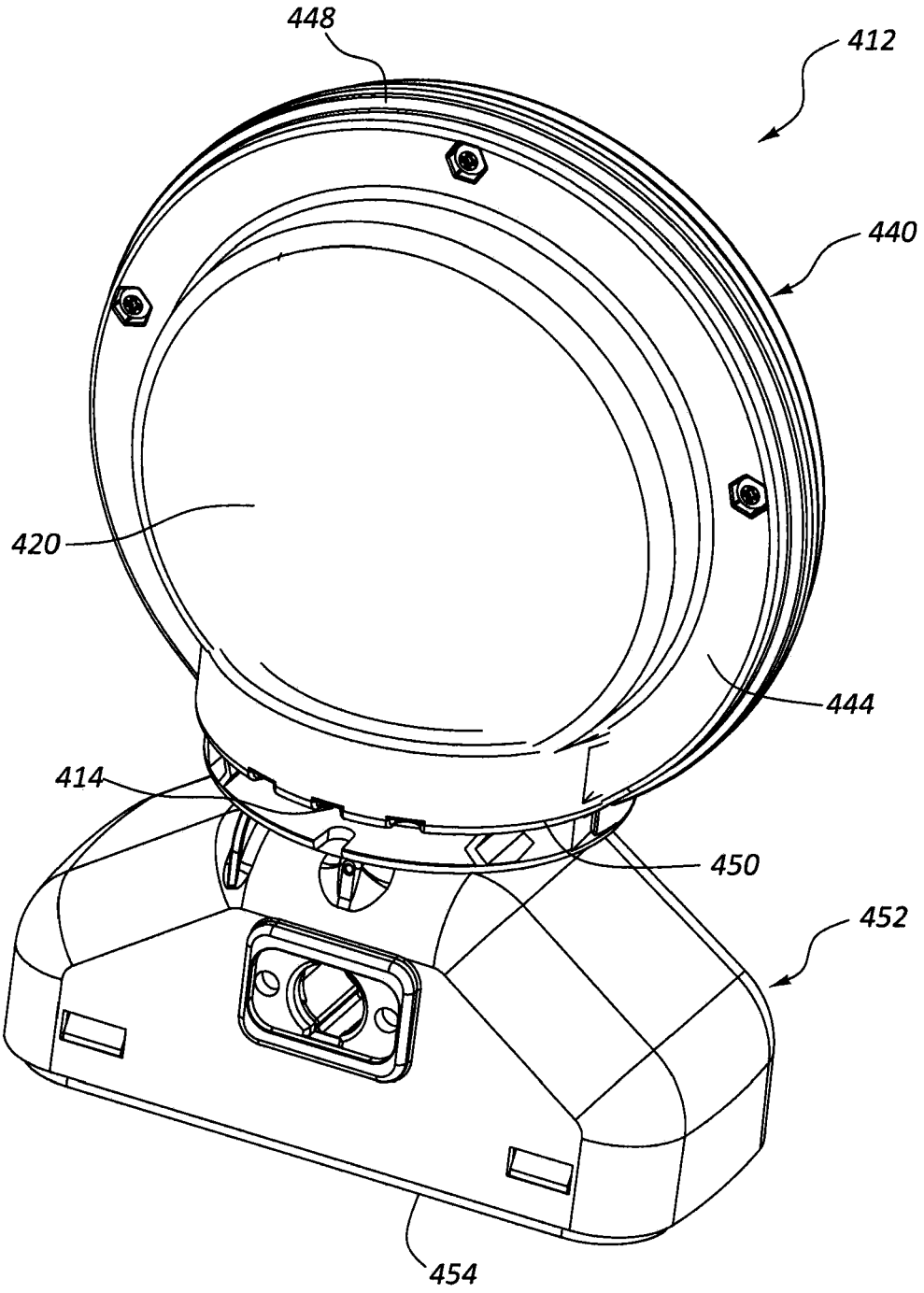
FIG. 36 is a perspective view of another example barricade light in accordance with the present disclosure.
Figure 37:
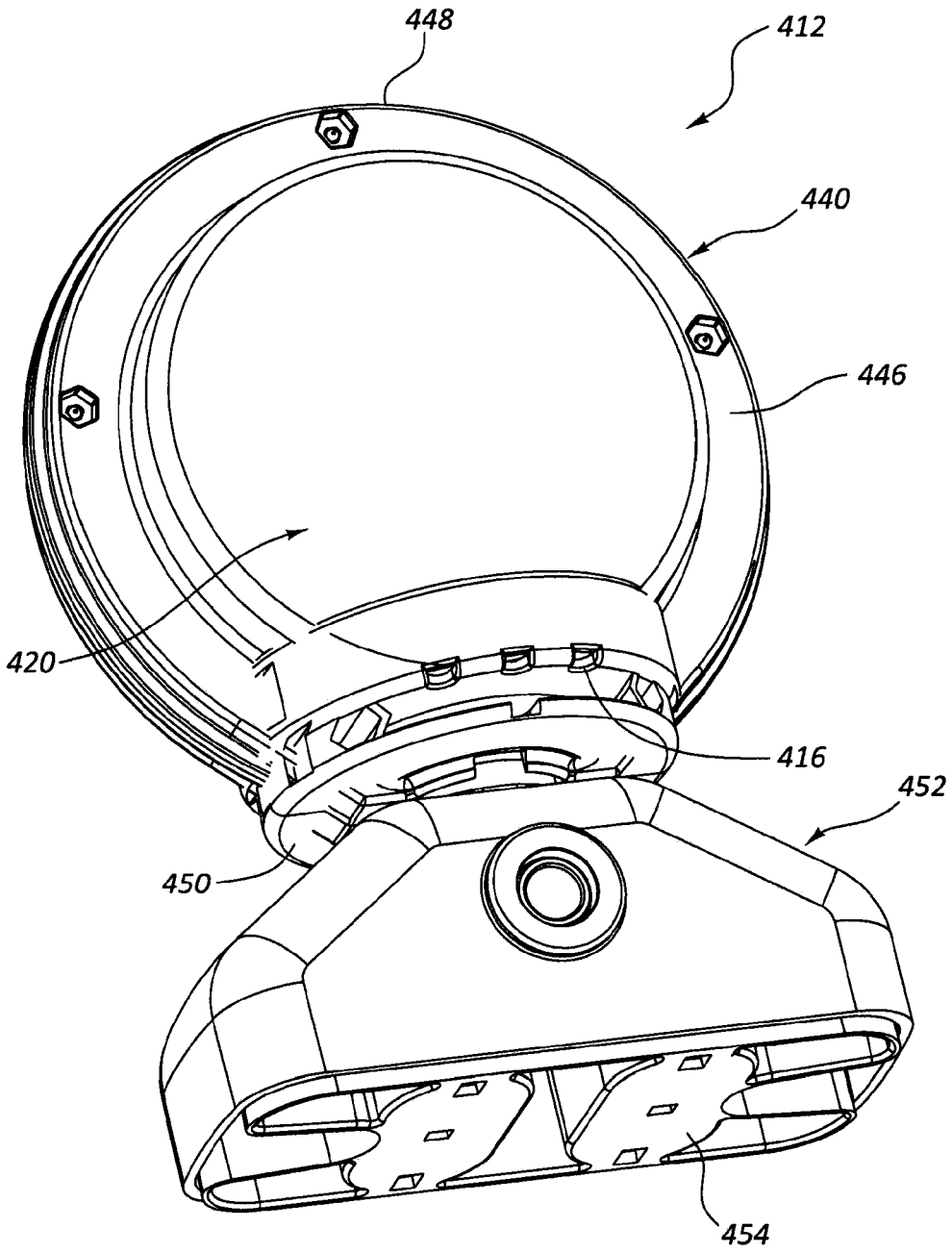
FIG. 37 is another perspective view of the barricade light shown in FIG. 36.
Figure 38:
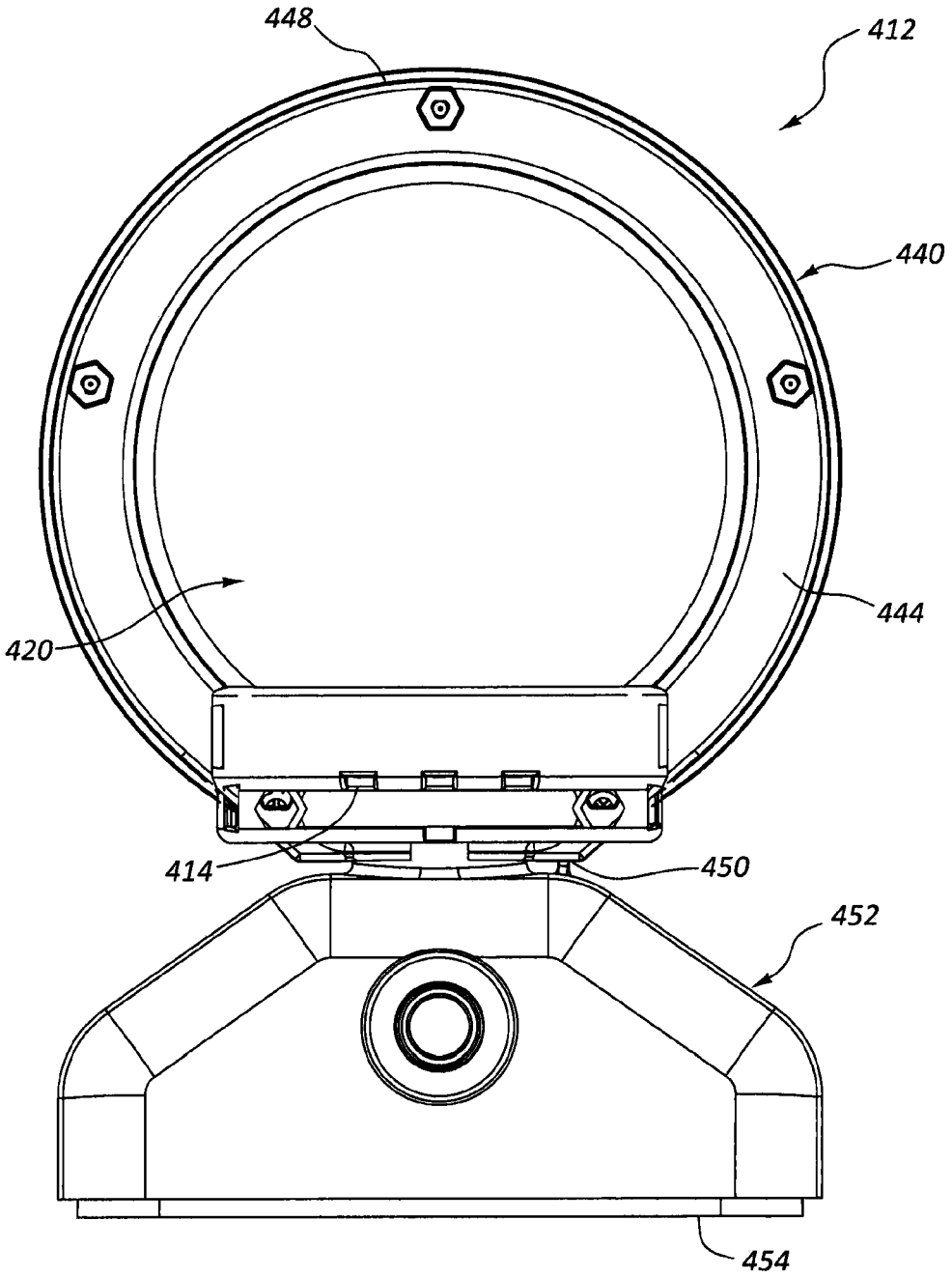
FIG. 38 is a front view of the barricade light of FIG. 36.
Figure 39:
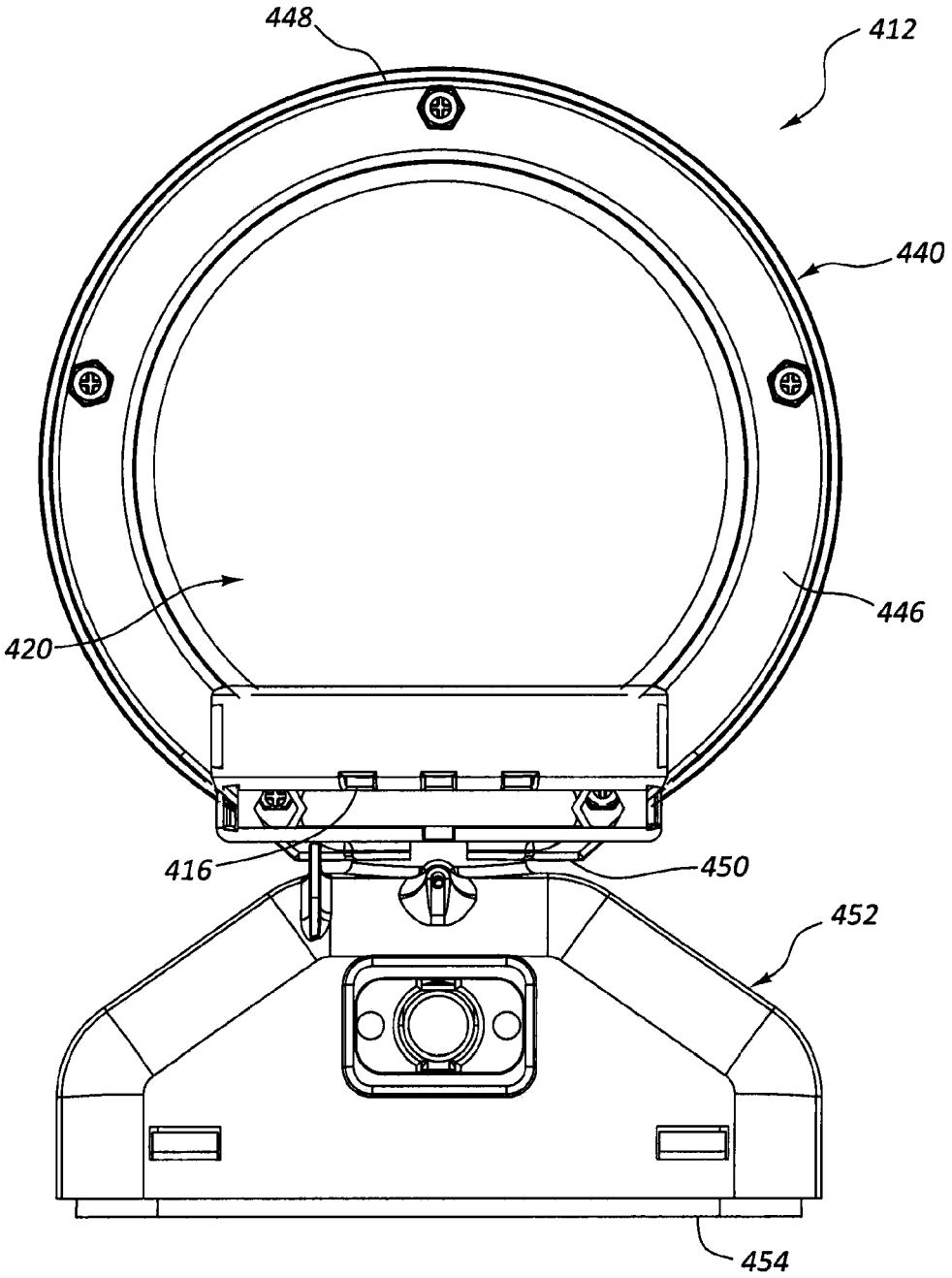
FIG. 39 is a rear view of the barricade light of FIG. 36.
Figure 40:
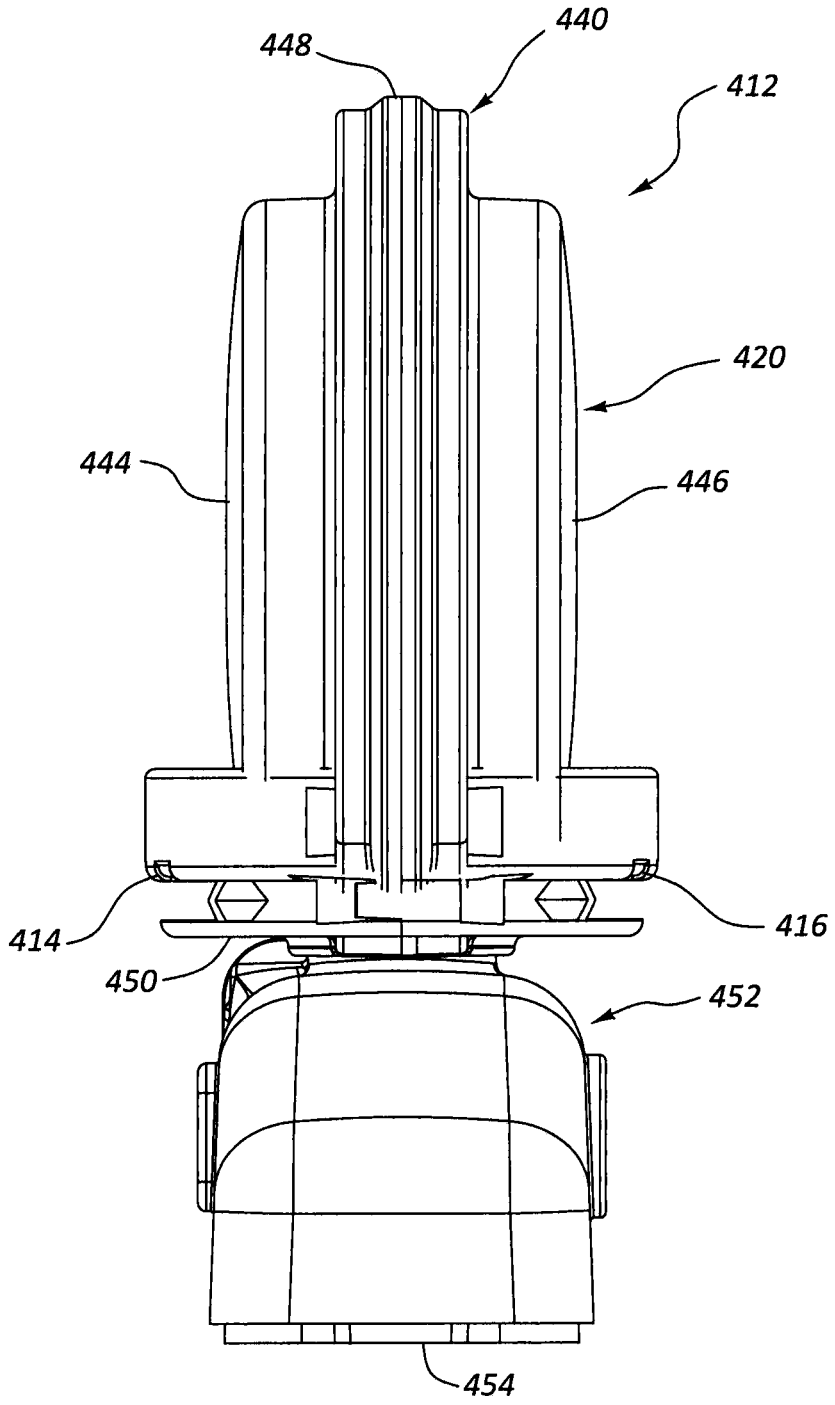
FIG. 40 is a left side view of the barricade light of FIG. 36.
Figure 41:
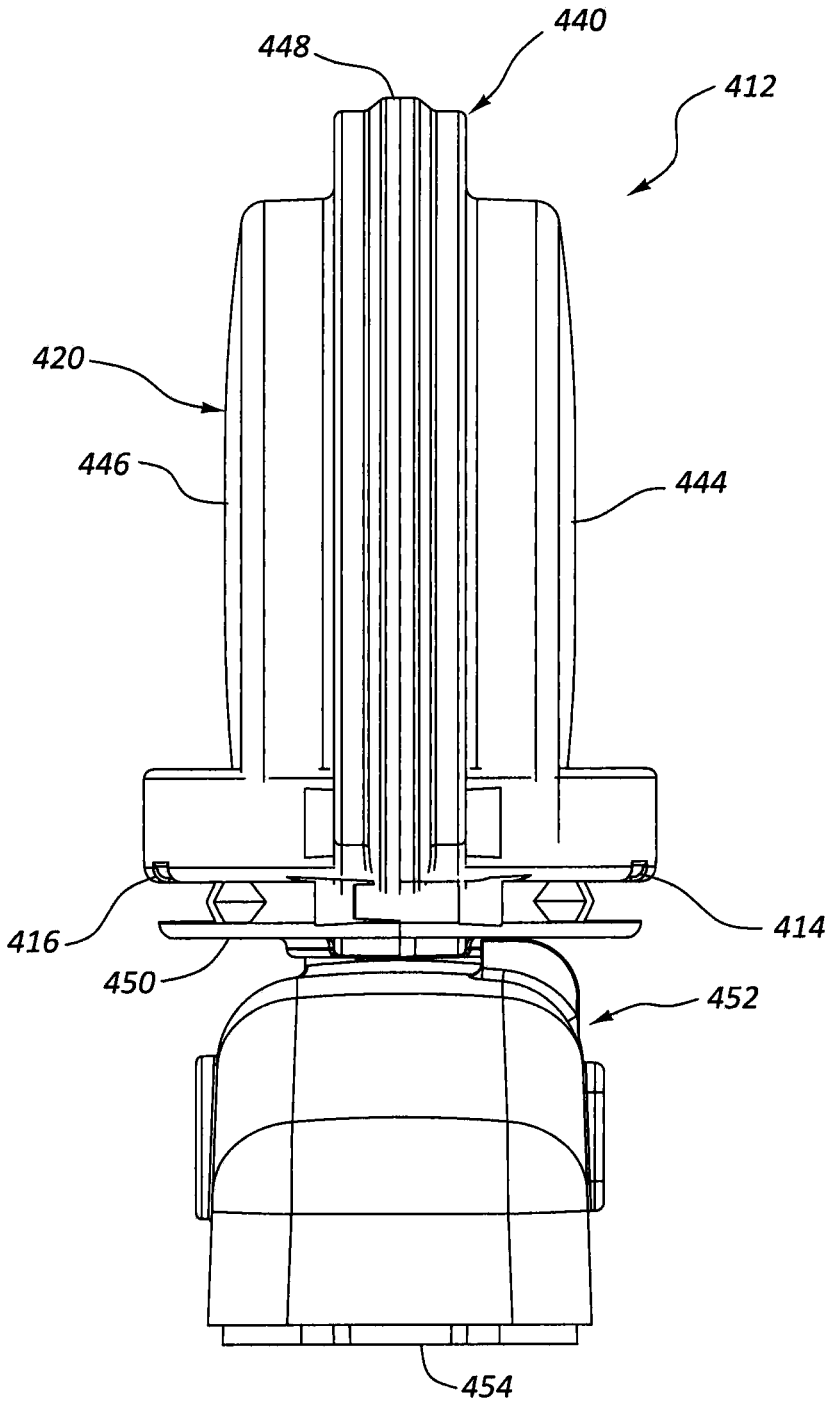
FIG. 41 is a right side view of the barricade light of FIG. 36.
Figure 42:
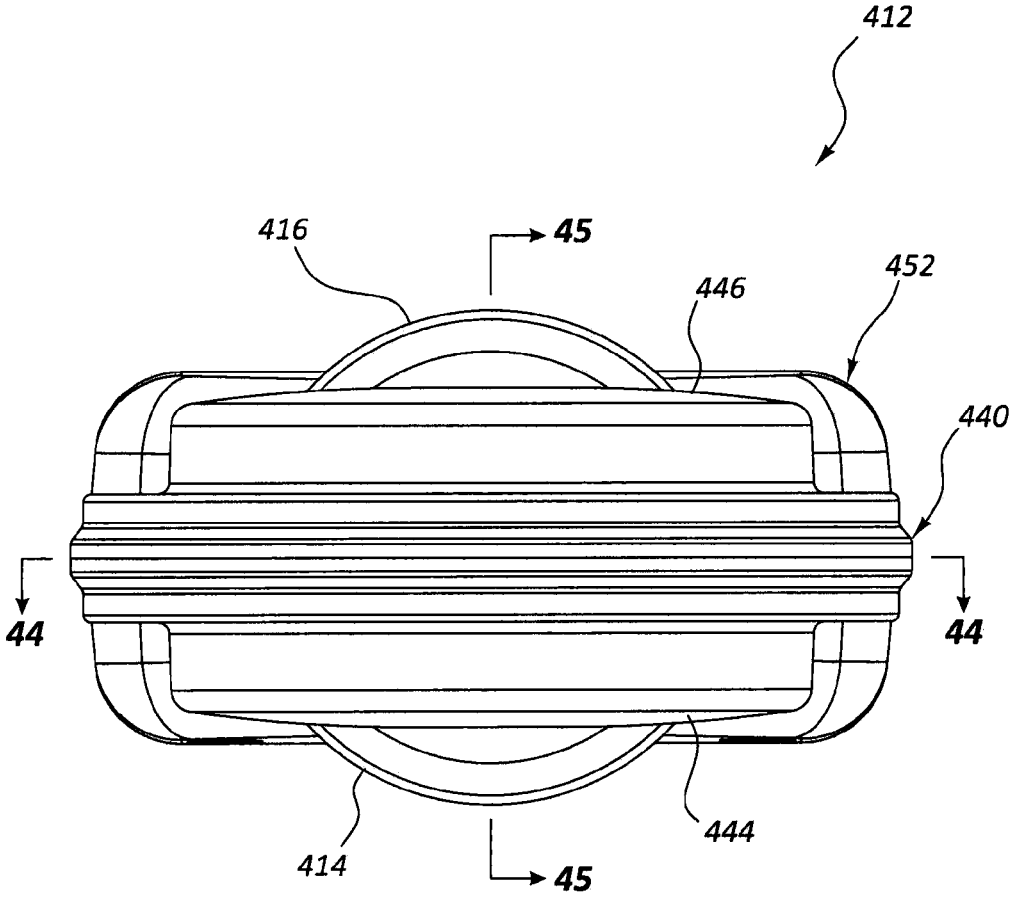
FIG. 42 is a top view of the barricade light of FIG. 36.
Figure 43:
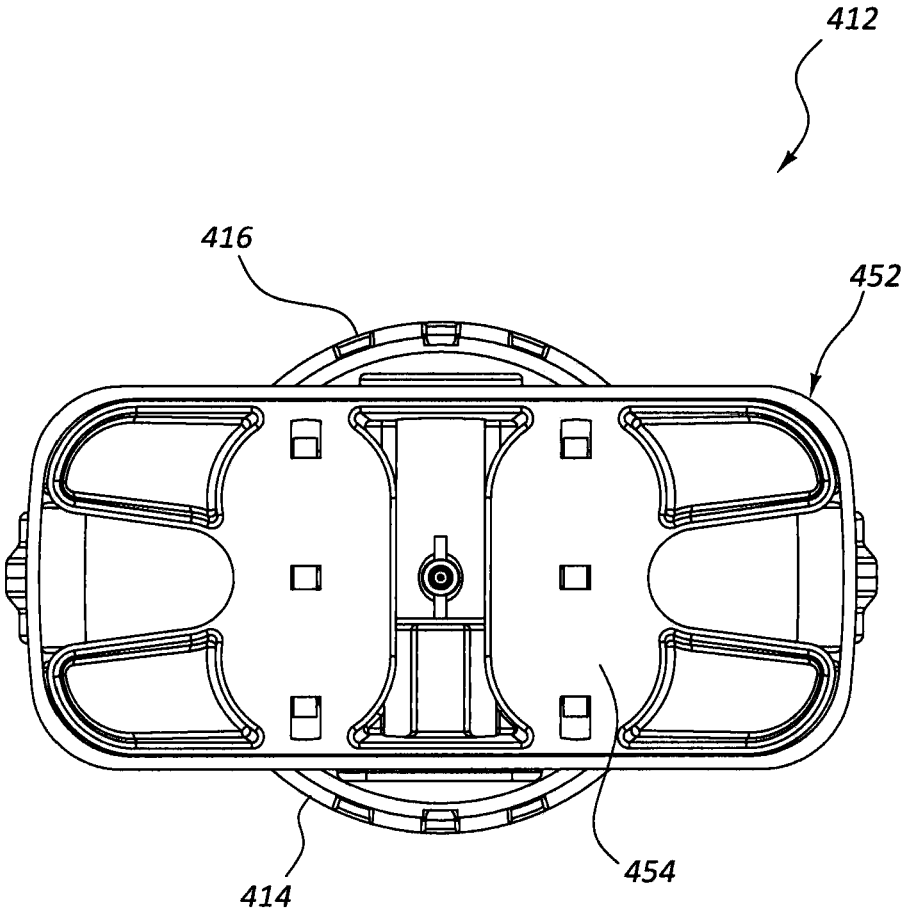
FIG. 43 is a bottom view of the barricade light of FIG. 36.
Figure 44:
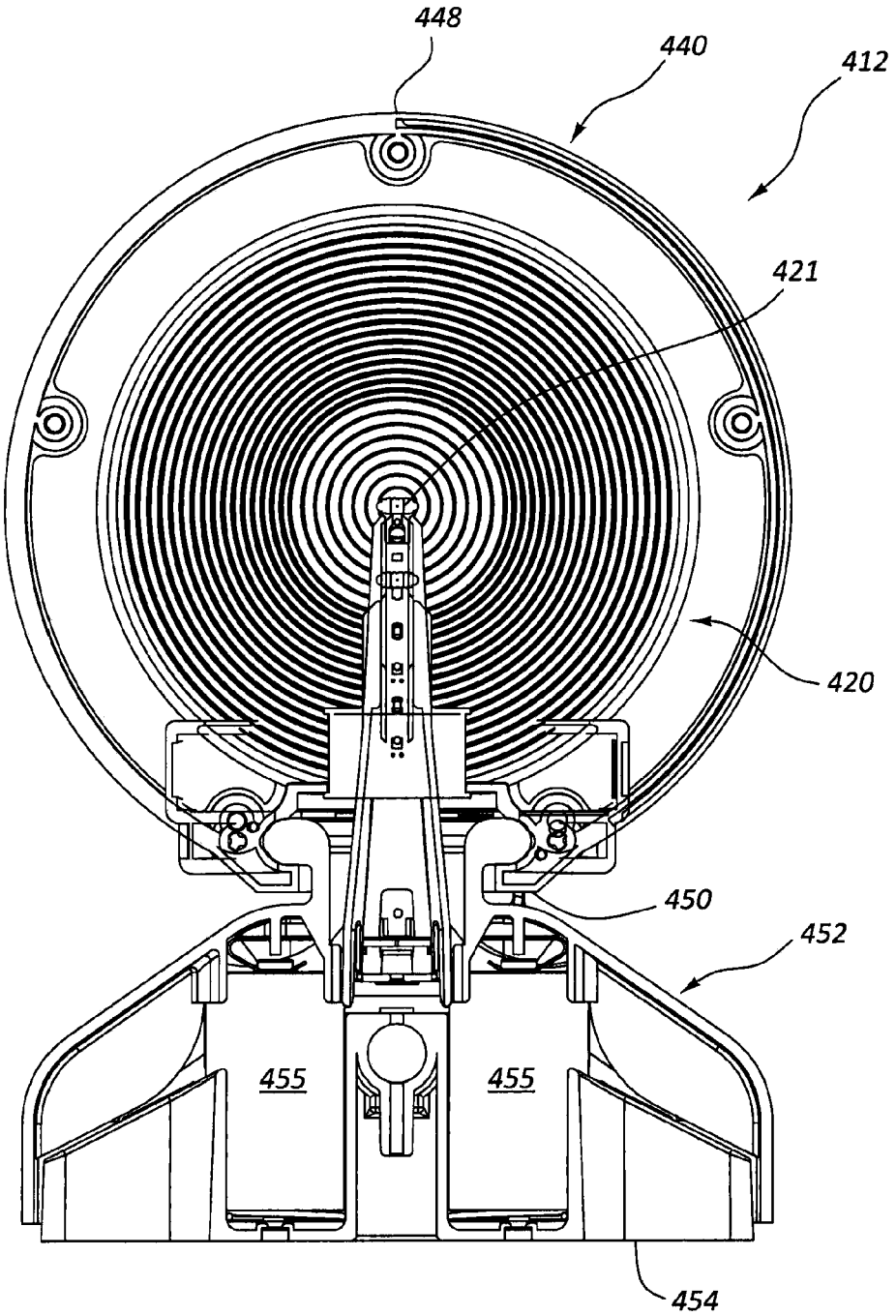
FIG. 44 is a cross-sectional view of the barricade light of FIG. 42 taken along cross-section indicators 14-14.
Figure 45:
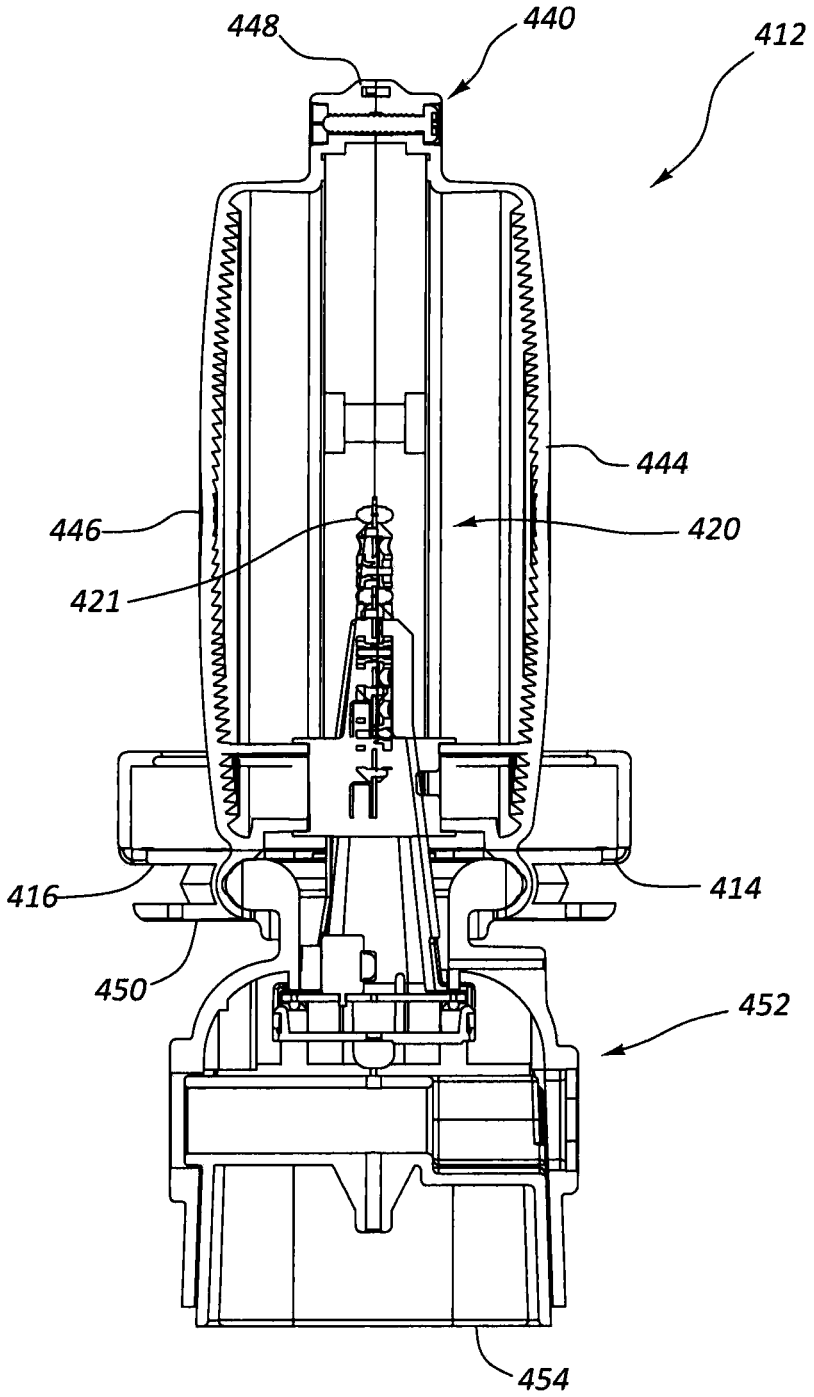
FIG. 45 is a cross-sectional view of the barricade light of FIG. 42 taken along cross-section indicators 15-15.

The barricade light 212 may include a plurality of rechargeable batteries 257 positioned at a rear portion of the light housing 140 (see FIG. 19). The rechargeable batteries 257 may be charged by power from the solar panel 158. In some examples, the support stand 252 may provide connection to a recharging station. The recharging station may provide recharging of the batteries 257 when, for example, there is insufficient power provided by solar panel 158 to maintain a full charge of the batteries 257.

Referring now to FIGS. 26-35, a further example barricade light 312 is shown including a different support portion in the form of a battery pack 352 and associated housing. The battery pack 352 includes a plurality of batteries 355 (see FIG. 34). The batteries 355 may be used in place of or in addition to rechargeable batteries 357 stored in a rear portion of the light housing 140 (see FIG. 29). The battery pack 352 may provide a support surface 354 that helps maintain the barricade light 312 in an upright position. The battery pack 352 and associated support surface 354 may be configured for attachment to a mounting structure using, for example, a snap-fit connection, an interference-fit connection, or a connection via fasteners. The mounting structure may be part of, for example, one of the barricades 102 described above with reference to FIG. 4.

The battery pack 352 may include a housing that is separable to provide access to the batteries 355. The batteries 355 may be rechargeable batteries that are recharged by, for example, power generated by solar panel 158. Alternatively, the batteries 355 may be replaceable batteries. In one example, the battery pack 352 may be easily detached from the light housing 140 when the batteries 355 become depleted. The battery pack 352 may be replaced in its entirety to provide a fresh source of battery power to the barricade light 312.

The various structures of the support stand 152, support stand 252, and battery pack 352 may be used with other types of barricade lights and are not limited to the solar barricade lights shown in FIGS. 6-35.

Referring now to FIGS. 36-45, another example barricade light 412 is shown including a receiver 414, a transmitter, 416, a control module 418, and a light device 420. The light device 420 includes a light housing 440 having front and rear portions 444, 446 and top and bottom portions 448, 450. The light housing 140 may permit light emission in both forward and rearward directions.

A battery pack 452 is mounted to the light housing 440. The battery pack 452 includes a plurality of batteries 455 and defines a support surface 454. The support surface 454 may hold the barricade light 412 in an upright position. The battery pack 452 may include attachment features for mounting a barricade light 412 to a mounting surface such as, for example, a portion of a barricade. The battery pack 452 may include a housing having an access portion that provides access to the batteries 455 (see FIG. 44). The batteries 455 may provide a source of power for operating the control module 418 and a light 421 (see FIGS. 44 and 45). The batteries 455 may be rechargeable.

All of the barricade lights 112, 212, 312, 412, described above, may have the capability of integrating with a sequential barricade light system as described above with reference to FIGS. 1-3. Features of the barricade lights 112, 212, 312, 412 may be interchangeable with each other and with other barricade light designs. The controller, transmitters and receivers, and their associated functions described herein may be integrated into barricade lights of other designs have a variety of functions without limitation.

Figure 46:
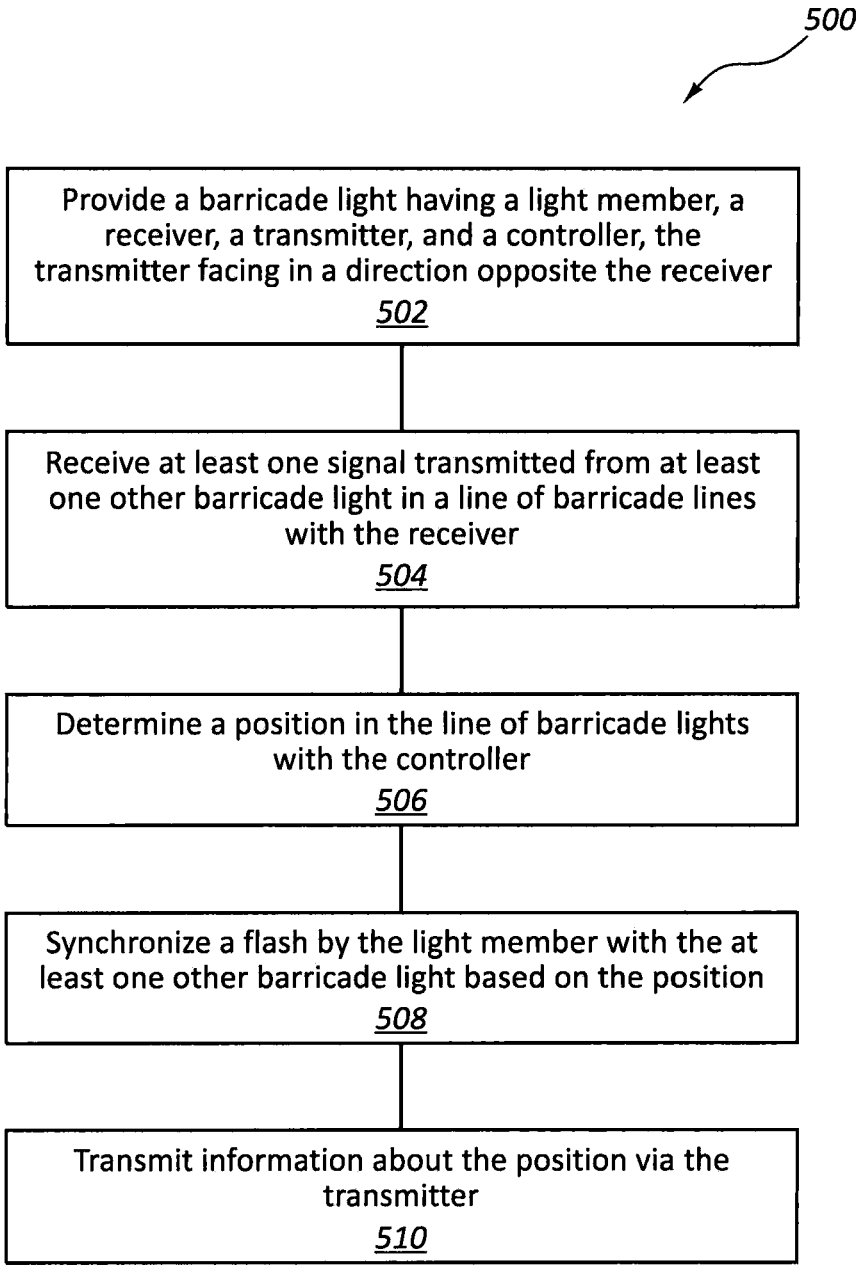
FIG. 46 is a flow diagram showing steps of an example method in accordance with the present disclosure.

A number of different methods are possible with the various barricade lights and associated sequential barricade light systems disclosed herein. Referring to FIG. 46, an example method 500 includes a step 502 of providing a barricade light having a light member, a receiver, a transmitter, and a controller, wherein the transmitter faces in a direction opposite the receiver. A step 504 includes receiving at least one signal transmitted from at least one other barricade light in a row of barricade lights with the receiver. A step 506 includes determining a position in the row of barricade lights with the controller. A step 508 includes synchronizing a flash by the light member with at least one other barricade light based on the determined position. A step 510 includes transmitting information about the position of the barricade light relative to other barricade lights via the transmitter.

The method 500 may also include steps of determining a position in the row of barricade lights, determining which of the at least one signals has a highest position value, and selecting a next highest position value for the position. The method 500 may include synchronizing a flash by the light member by generating the flash about ⅙ second after receiving the at least one signal, wherein synchronizing the flash includes generating a flash by the light member every 1 second. The method 500 may include any one of the steps of masking the at least one signal if not received within a ⅙ second interval of receiving other signals of the at least one signal, transmitting information about the position prior to generating a flash with the flash member, generating the flash within 50 milliseconds of transmitting information about the position, receiving in a first direction and transmitting in an opposite direction, directing a flash of the light member in a direction opposite of transmitting information about the position, providing the barricade light with an ambient light sensor, and automatically dimming a light output of the light member based on an output of the ambient light sensor.

Figure 47:
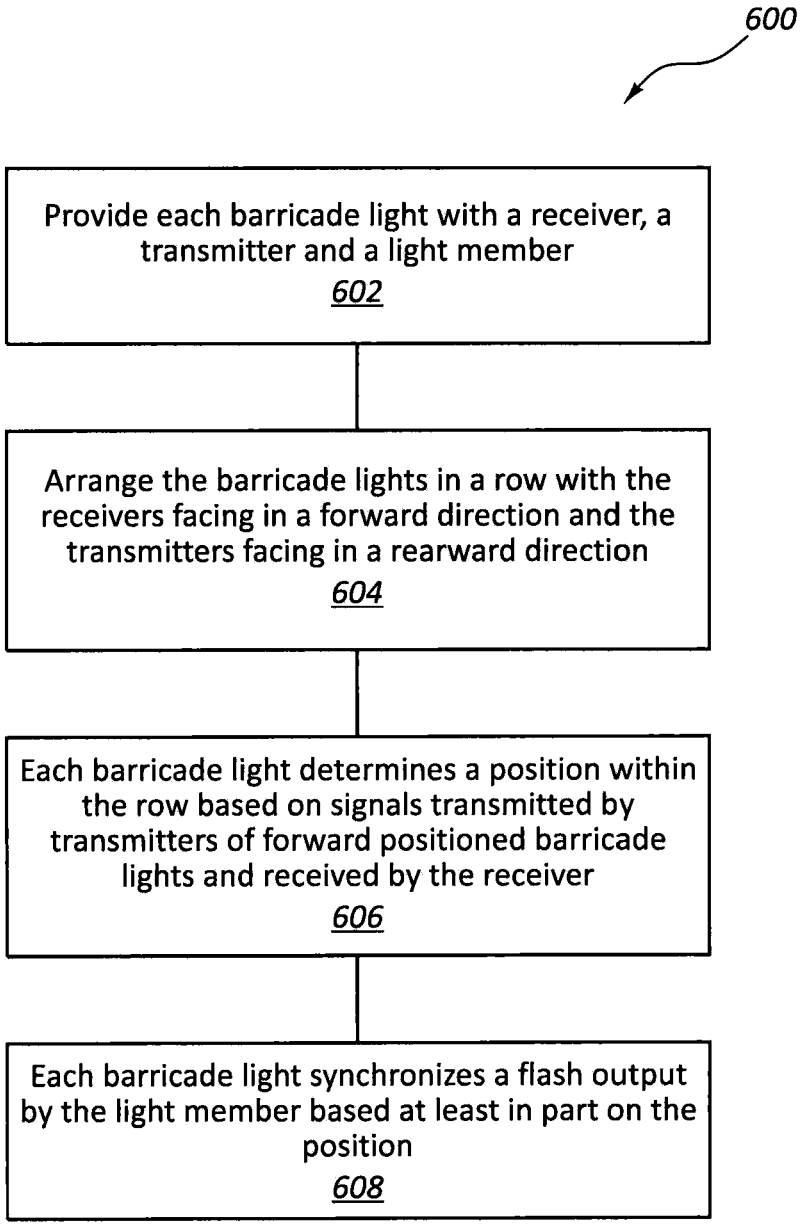
FIG. 47 is a flow diagram showing steps of another example method in accordance with the present disclosure.

FIG. 47 shows steps of another example method 600. The method 600 includes providing each barricade light with a receiver, a transmitter, a light member, in a step 602. A step 604 includes arranging the barricade lights in a row with the receivers facing in a forward direction and the transmitters facing in a rearward direction. A step 606 includes each barricade light determining a position within the row based on signals transmitted by transmitters of forward-positioned barricade lights, which signals are received by the receiver. A step 608 includes each barricade light synchronizing a flash output by the light member based at least in part on the determined position relative to the other barricade lights.

The method 600 may also include providing the signal with information about a position of the barricade light and transmitting the signal just prior to generating a flash by the light member. The method 600 may include, upon start up of the barrier light, scanning for signals transmitted by transmitters of forward positioned barricade lights, and if no signal is received, determining a first position for the barricade light and then generating a flash by the light member. The method may include, upon start up of the barrier light, scanning for signals transmitted by transmitters of forward positioned barricade lights, and if a signal is received, determining the position for the barricade light based on the signal, and then waiting to receive the same signal to synchronize the flash by the light member. The method 600 may also include any one of the steps of waiting for about ⅙ second after receiving the second of the same signal before generating the flash, transmitting an output signal with the position prior to generating the flash, coding the position with a position value between 0 and 15, and spacing the barricade lights between about 3 ft. and about 100 ft., and more preferable about 6 ft. apart and about 60 ft. apart.

Many other methods and method steps are possible based on the examples disclosed herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A barricade light, comprising:

a light member;

a receiver;

a transmitter;

a controller;

wherein the receiver is configured to receive an incoming signal from an adjacent barricade light and deliver the incoming signal to the controller, the incoming signal comprising information about a position of the adjacent barricade light in a row of barricade lights, the controller configured to determine a position of the barricade light in the row of barricade lights based on the information, synchronize operation of the light member to the adjacent barricade light, and transmit an outgoing signal via the transmitter, the outgoing signal comprising information about a position of the barricade light in the row of barricade lights.

2. The barricade light of claim 1, wherein the transmitter is configured to transmit an infrared (IR) signal.

3. The barricade light of claim 1, wherein the light member comprises a high intensity light emitting diode (LED).

4. The barricade light of claim 1, wherein the light member operates to generate a flash of light.

5. The barricade light of claim 4, wherein the light member operates to maintain a backlight state between flashes.

6. The barricade light of claim 1, further comprising a solar panel configured to generate solar power for operation of the barricade light.

7. The barricade light of claim 1, further comprising a rechargeable battery.

8. The barricade light of claim 7, wherein the rechargeable battery comprises a LiFePO battery.

9. The barricade light of claim 1, further comprising an ambient light sensor configured to generate a dimming signal when a light condition exceeds a threshold condition, the controller automatically dimming the light member in response to the dimming signal.

10. The barricade light of claim 1, wherein the information includes timing of operation of the adjacent barricade light.

11. The barricade light of claim 7, wherein the receiver faces in a direction opposite the transmitter.

12. A barricade light assembly, comprising:

a plurality of barricade lights aligned in a row, each barricade light comprising:

a light member;

a receiver;

a transmitter;

a controller;

wherein the receiver of a first barricade light is configured to receive an incoming signal from a second barricade light, the incoming signal comprising information about a position of the second barricade light in the row, the controller of the first barricade light configured to determine a position of the first barricade light in the row based on the information, synchronize operation of the light member to operation of the light member of the second barricade light, and transmit an outgoing signal via the transmitter to the receiver of a third barricade light, the outgoing signal comprising information about the position of the first barricade light.

13. The barricade light assembly of claim 12, wherein the receiver of the first barricade light is configured to receive an incoming signal from a plurality of barricade lights, each incoming signal comprising a position value representing a position of the barricade light in the row, and the controller of the first barricade light is configured to determine which incoming signal has a highest position value.

14. The barricade light assembly of claim 12, wherein the light member and receiver of each barricade light faces forward, and the transmitter of each barricade light faces rearward.

15. The barricade light assembly of claim 12, wherein each barricade light further comprises a solar panel.

16. The barricade light assembly of claim 12, wherein the controller of each barricade light automatically updates a flashing sequence of the light member based on a flashing sequence of an adjacent barricade light.

17. A method of operating a barricade light, comprising:

providing a barricade light having a light member, a receiver, a transmitter, and a controller, the transmitter facing in a direction opposite the receiver;

receiving at least one signal transmitted from at least one other barricade light in a row of barricade lights with the receiver;

determining a position in the row of barricade lights with the controller;

synchronizing a flash by the light member with the at least one other barricade light based on the position;

transmitting information about the position via the transmitter.

18. The method of claim 17, wherein determining a position in the row of barricade lights includes determining which one of the at least one signal has a highest position value, and assigning the barricade light a next highest position value.

19. The method of claim 17, wherein synchronizing a flash by the light member comprises generating the flash about ⅙ second after receiving the at least one signal.

20. The method of claim 17, wherein synchronizing the flash includes generating a flash by the light member every 1 second.

21. The method of claim 17, further comprising masking the at least one signal if not received within about a ⅙ second interval of receiving other signals of the at least one signal.

22. The method of claim 17, further comprising transmitting information about the position prior to generating a flash with the light member.

23. The method of claim 22, wherein generating the flash within about 50 milliseconds of transmitting information about the position.

24. The method of claim 17, wherein receiving occurs in a first direction, and transmitting occurs in an opposite direction.

25. The method of claim 17, further comprising directing a flash of the light member in a direction opposite of transmitting information about the position.

26. The method of claim 17, further comprising providing the barricade light with an ambient light sensor, and automatically dimming a light output of the light member based on an output of the ambient light sensor.

27. A method of operating a group of barricade lights, comprising:

providing each barricade light with a receiver, a transmitter and a light member;

arranging the group of barricade lights in a row with the receiver of each barricade light facing in a forward direction and the transmitter of each barricade light facing in a rearward direction;

each barricade light determining a position within the row based on signals transmitted by transmitters of forward positioned barricade lights and received by the receiver;

each barricade light synchronizing a flash output by the light member based at least in part on the position.

28. The method of claim 27, wherein the signals comprise information about a position of the barricade light.

29. The method of claim 27, wherein the signals are transmitted just prior to generating a flash by the light member.

30. The method of claim 27, wherein upon start up of the barricade light, the barricade light scans for signals transmitted by transmitters of forward positioned barricade lights, and if a signal is not received, determines a 0 position for the barricade light and then generates a flash by the light member.

31. The method of claim 27, wherein upon start up of the barricade light, the barricade light scans for signals transmitted by transmitters of forward positioned barricade lights, and if a signal is received, determines the position for the barricade light based on the signal, and then waits for the same signal to be received again to synchronize a flash by the light member with flashes by other barricade lights.

32. The method of claim 31, wherein the barricade light waits for about ⅙ second after receiving the second of the same signal before generating the flash.

33. The method of claim 32, wherein the barricade light transmits an output signal with the position prior to generating the flash.

34. The method of claim 27, wherein the position is coded with a position value between 0 and 15.

35. The method of claim 27, further comprising spacing the barricade lights between about 6 ft. apart and about 60 ft. apart.

* * * * *